US008551194B2

(12) United States Patent
Uptain et al.

(10) Patent No.: US 8,551,194 B2
(45) Date of Patent: Oct. 8, 2013

(54) PRILLED WAXES COMPRISING SMALL PARTICLES AND SMOOTH-SIDED COMPRESSION CANDLES MADE THEREFROM

(75) Inventors: Kevin D. Uptain, Minneapolis, MN (US); Timothy A. Murphy, Yorkville, IL (US); Scott Walters, Sugar Grove, IL (US); John M. Zupfer, Mounds View, MN (US)

(73) Assignee: Elevance Renewable Sciences, Inc., Woodridge, IL (US)

( * ) Notice: Subject to any disclaimer, the term of this patent is extended or adjusted under 35 U.S.C. 154(b) by 982 days.

(21) Appl. No.: 12/627,732

(22) Filed: Nov. 30, 2009

(65) Prior Publication Data

US 2010/0132250 A1 Jun. 3, 2010

Related U.S. Application Data

(63) Continuation of application No. PCT/US2008/065395, filed on May 30, 2008.

(60) Provisional application No. 60/932,338, filed on May 30, 2007.

(51) Int. Cl.
*C11C 5/00* (2006.01)

(52) U.S. Cl.
CPC ..... *C11C 5/002* (2013.01)
USPC ..... 44/275

(58) Field of Classification Search
CPC ..... C11C 5/002
USPC ..... 44/275
See application file for complete search history.

(56) References Cited

U.S. PATENT DOCUMENTS

| | | | |
|---|---|---|---|
| 1,935,946 | A | 11/1933 | Egan et al. |
| 1,954,659 | A | 4/1934 | Will |
| 2,468,799 | A | 5/1949 | Ziels et al. |
| 2,784,891 | A | 3/1957 | Thielke |
| 3,448,178 | A | 6/1969 | Flanagan |
| 3,630,697 | A | 12/1971 | Duling et al. |
| 3,645,705 | A | 2/1972 | Miller et al. |
| 3,744,956 | A | 7/1973 | Hess |
| 3,844,706 | A | 10/1974 | Tsaras |

(Continued)

FOREIGN PATENT DOCUMENTS

| | | |
|---|---|---|
| DE | 19956226 | 5/2001 |
| EP | 0536861 A1 | 4/1993 |

(Continued)

OTHER PUBLICATIONS

International Search Report and Written Opinion of the International Searching Authority for International Application No. PCT/US2008/065395, dated Sep. 29, 2008, 6 pages.

(Continued)

*Primary Examiner* — Cephia D Toomer
(74) *Attorney, Agent, or Firm* — Brinks Hofer Gilson & Lione

(57) ABSTRACT

A candle and process for making it are disclosed. The candle comprises prilled wax particles, comprising hydrogenated natural oil and wherein at least 75% of the prilled wax particles are less than 800 μm in diameter. The candle includes a compressed core and a thermally fused outer layer.

20 Claims, 14 Drawing Sheets

(56) References Cited

U.S. PATENT DOCUMENTS

| | | | |
|---|---|---|---|
| 4,118,203 | A | 10/1978 | Beardmore et al. |
| 4,134,718 | A | 1/1979 | Kayfetz et al. |
| 4,292,088 | A | 9/1981 | Scheuffgen et al. |
| 4,293,345 | A | 10/1981 | Zeilstra et al. |
| 4,314,915 | A | 2/1982 | Wiegers et al. |
| 4,390,590 | A | 6/1983 | Saunders et al. |
| 4,411,829 | A | 10/1983 | Schulte-Elte et al. |
| 4,434,306 | A | 2/1984 | Kobayashi et al. |
| 4,507,077 | A | 3/1985 | Sapper |
| 4,545,941 | A | 10/1985 | Rosenburg |
| 4,554,107 | A | 11/1985 | Takao |
| 4,567,548 | A | 1/1986 | Schneeberger |
| 4,608,011 | A | 8/1986 | Comstock |
| 4,614,625 | A | 9/1986 | Wilson |
| 4,623,488 | A | 11/1986 | Takao |
| 4,714,496 | A | 12/1987 | Luken, Jr. et al. |
| 4,759,709 | A | 7/1988 | Luken, Jr. et al. |
| 4,813,975 | A | 3/1989 | Poulina et al. |
| 4,842,648 | A | 6/1989 | Phadoemchit et al. |
| 4,855,098 | A | 8/1989 | Taylor |
| 4,923,708 | A | 5/1990 | Given, Jr. |
| 5,171,329 | A | 12/1992 | Lin |
| 5,258,197 | A | 11/1993 | Wheeler et al. |
| 5,338,187 | A | 8/1994 | Elharar |
| 5,380,544 | A | 1/1995 | Klemann et al. |
| 5,578,089 | A | 11/1996 | Elsamaloty |
| 5,660,865 | A | 8/1997 | Pedersen et al. |
| 5,700,516 | A | 12/1997 | Sandvick et al. |
| 5,723,137 | A | 3/1998 | Wahle et al. |
| 5,753,015 | A | 5/1998 | Sinwald et al. |
| 5,843,194 | A | 12/1998 | Spaulding |
| 5,885,600 | A | 3/1999 | Blum et al. |
| 5,888,487 | A | 3/1999 | Baumoeller et al. |
| 6,001,286 | A | 12/1999 | Sleeter |
| 6,019,804 | A | 2/2000 | Requejo et al. |
| 6,022,402 | A | 2/2000 | Stephenson et al. |
| 6,063,144 | A | 5/2000 | Calzada et al. |
| 6,099,877 | A | 8/2000 | Schuppan |
| 6,103,308 | A | 8/2000 | Floyd et al. |
| 6,106,597 | A | 8/2000 | Starks et al. |
| 6,123,979 | A | 9/2000 | Hepburn et al. |
| 6,127,326 | A | 10/2000 | Dieckmann et al. |
| 6,132,742 | A | 10/2000 | Le Bras et al. |
| 6,156,369 | A | 12/2000 | Eger et al. |
| 6,201,053 | B1 | 3/2001 | Dieckmann et al. |
| 6,214,918 | B1 | 4/2001 | Johnson et al. |
| 6,224,641 | B1 | 5/2001 | Matzat et al. |
| 6,238,926 | B1 | 5/2001 | Liu et al. |
| 6,255,375 | B1 | 7/2001 | Michelman |
| 6,258,965 | B1 | 7/2001 | O'Lenick, Jr. |
| 6,262,153 | B1 | 7/2001 | Webster et al. |
| 6,276,925 | B1 | 8/2001 | Varga |
| 6,277,310 | B1 | 8/2001 | Sleeter |
| 6,284,007 | B1 | 9/2001 | Tao |
| 6,497,735 | B2 | 12/2002 | Tao |
| 6,503,077 | B2 | 1/2003 | Orth et al. |
| 6,503,285 | B1 | 1/2003 | Murphy |
| 6,582,748 | B1 | 6/2003 | Loh et al. |
| 6,586,506 | B2 | 7/2003 | Webster et al. |
| 6,599,334 | B1 | 7/2003 | Anderson |
| 6,645,261 | B2 | 11/2003 | Murphy et al. |
| 6,673,763 | B1 | 1/2004 | Hansen et al. |
| 6,730,137 | B2 | 5/2004 | Pesu et al. |
| 6,733,548 | B2 | 5/2004 | Rasmussen et al. |
| 6,758,869 | B2 | 7/2004 | Roeske et al. |
| 6,770,104 | B2 | 8/2004 | Murphy |
| 6,773,469 | B2 | 8/2004 | Murphy |
| 6,797,020 | B2 | 9/2004 | Murphy |
| 6,824,572 | B2 | 11/2004 | Murphy |
| 6,846,573 | B2 | 1/2005 | Seydel |
| 6,852,140 | B1 | 2/2005 | Roeske |
| 6,943,262 | B2 | 9/2005 | Kodali et al. |
| 7,037,439 | B2 | 5/2006 | Tavares |
| 7,128,766 | B2 | 10/2006 | Murphy et al. |
| 7,176,171 | B2 | 2/2007 | Nieendick et al. |
| 7,192,457 | B2 | 3/2007 | Murphy et al. |
| 7,217,301 | B2 | 5/2007 | Murphy et al. |
| 7,387,649 | B2 | 6/2008 | Tao |
| 7,462,205 | B2 | 12/2008 | Murphy |
| 7,510,584 | B2 | 3/2009 | Cap |
| 7,569,084 | B2 | 8/2009 | Tao et al. |
| 7,588,607 | B1 | 9/2009 | Cap |
| 7,601,184 | B2 | 10/2009 | Tischendorf |
| 7,637,968 | B2 | 12/2009 | Murphy |
| 2001/0013195 | A1 | 8/2001 | Tao |
| 2001/0051680 | A1 | 12/2001 | Webster et al. |
| 2002/0005007 | A1 | 1/2002 | Roeske et al. |
| 2002/0144455 | A1 | 10/2002 | Bertrand et al. |
| 2002/0157303 | A1 | 10/2002 | Murphy et al. |
| 2003/0008257 | A1 | 1/2003 | Tao |
| 2003/0017431 | A1 | 1/2003 | Murphy |
| 2003/0022121 | A1 | 1/2003 | Biggs |
| 2003/0046860 | A1 | 3/2003 | Tiffany et al. |
| 2003/0057599 | A1 | 3/2003 | Murphy et al. |
| 2003/0061760 | A1 | 4/2003 | Tao et al. |
| 2003/0091949 | A1 | 5/2003 | Pesu et al. |
| 2003/0110683 | A1 | 6/2003 | Murphy |
| 2003/0134244 | A1 | 7/2003 | Gray et al. |
| 2003/0198826 | A1 | 10/2003 | Seydel |
| 2003/0207971 | A1 | 11/2003 | Stuart, Jr. et al. |
| 2003/0213163 | A1 | 11/2003 | Berger et al. |
| 2004/0000088 | A1 | 1/2004 | Wesley |
| 2004/0037859 | A1 | 2/2004 | Cecchi et al. |
| 2004/0047886 | A1 | 3/2004 | Murphy et al. |
| 2004/0076732 | A1 | 4/2004 | Valix |
| 2004/0088907 | A1 | 5/2004 | Murphy |
| 2004/0088908 | A1 | 5/2004 | Murphy |
| 2004/0138359 | A1 | 7/2004 | Dinkelaker et al. |
| 2004/0200136 | A1 | 10/2004 | Tao et al. |
| 2004/0221503 | A1 | 11/2004 | Murphy et al. |
| 2004/0221504 | A1 | 11/2004 | Murphy |
| 2005/0014664 | A1 | 1/2005 | Nadolsky et al. |
| 2005/0060927 | A1 | 3/2005 | Murphy |
| 2005/0095545 | A1 | 5/2005 | Tischendorf |
| 2005/0123780 | A1 | 6/2005 | Seydel |
| 2005/0158679 | A1* | 7/2005 | Chen et al. ..... 431/189 |
| 2005/0269728 | A1 | 12/2005 | Roos |
| 2006/0236593 | A1 | 10/2006 | Cap |
| 2006/0272199 | A1 | 12/2006 | Licciardello et al. |
| 2006/0272200 | A1 | 12/2006 | Murphy et al. |
| 2007/0006521 | A1 | 1/2007 | Licciardello et al. |
| 2007/0006522 | A1 | 1/2007 | Tao |
| 2007/0039237 | A1 | 2/2007 | Murphy et al. |
| 2007/0056211 | A1 | 3/2007 | Li et al. |
| 2007/0144058 | A1* | 6/2007 | Chen et al. ..... 44/275 |
| 2007/0151480 | A1 | 7/2007 | Bloom et al. |
| 2007/0270621 | A1 | 11/2007 | Millis et al. |
| 2007/0282000 | A1 | 12/2007 | Murphy et al. |
| 2008/0027194 | A1 | 1/2008 | Schrodi |
| 2008/0064891 | A1 | 3/2008 | Lee |
| 2008/0138753 | A1 | 6/2008 | Tao et al. |
| 2008/0145808 | A1 | 6/2008 | Lee |
| 2008/0206411 | A1 | 8/2008 | Nielsen |
| 2008/0307696 | A1 | 12/2008 | Wu et al. |
| 2009/0048459 | A1 | 2/2009 | Tupy et al. |
| 2009/0119977 | A1 | 5/2009 | Murphy |
| 2009/0217568 | A1 | 9/2009 | Murphy et al. |
| 2009/0259065 | A1 | 10/2009 | Abraham et al. |
| 2009/0264672 | A1 | 10/2009 | Abraham et al. |
| 2010/0024281 | A1 | 2/2010 | Lemke et al. |
| 2010/0044924 | A1 | 2/2010 | Cap |
| 2010/0047499 | A1 | 2/2010 | Braksmayer et al. |
| 2010/0145086 | A1 | 6/2010 | Schrodi et al. |
| 2010/0205851 | A1 | 8/2010 | Uptain et al. |

FOREIGN PATENT DOCUMENTS

| | | | |
|---|---|---|---|
| EP | 0545715 | A1 | 6/1993 |
| EP | 0685554 | A1 | 12/1995 |
| EP | 0811664 | A1 | 12/1997 |
| EP | 1801096 | A1 | 6/2007 |
| JP | 56-32550 | A | 4/1981 |
| JP | 04-59897 | A | 2/1992 |
| JP | 06-009987 | A | 1/1994 |
| JP | 09-014574 | A | 1/1997 |

| | | | |
|---|---|---|---|
| WO | WO 92/00269 | | 1/1992 |
| WO | WO 96/00815 | A1 | 1/1996 |
| WO | WO 96/14373 | A1 | 5/1996 |
| WO | WO 98/45390 | A1 | 10/1998 |
| WO | WO 99/27043 | A1 | 6/1999 |
| WO | WO 02/30386 | A1 | 4/2002 |
| WO | WO 02/092736 | A1 | 11/2002 |
| WO | WO 03/012016 | A1 | 2/2003 |
| WO | WO 03/051134 | A2 | 6/2003 |
| WO | WO 03/057983 | A1 | 7/2003 |
| WO | WO 03/104348 | A1 | 12/2003 |
| WO | WO 2004/033388 | A1 | 4/2004 |
| WO | WO 2004/083310 | A1 | 9/2004 |
| WO | WO 2004/101720 | A1 | 11/2004 |
| WO | WO 2005/042655 | A2 | 5/2005 |
| WO | WO 2006/041011 | A1 | 4/2006 |
| WO | WO 2006/076364 | A2 | 7/2006 |
| WO | WO 2007/002999 | A1 | 1/2007 |
| WO | WO 2008/008420 | A1 | 1/2008 |
| WO | WO 2008/010961 | A2 | 1/2008 |
| WO | WO 2008/048520 | A2 | 4/2008 |
| WO | WO 2008/103289 | A1 | 8/2008 |
| WO | WO 2008/140468 | A2 | 11/2008 |
| WO | WO 2008/151064 | A1 | 12/2008 |
| WO | WO 2008/157436 | A1 | 12/2008 |

OTHER PUBLICATIONS

Extended European Search Report for counterpart European Application No. 08769920.3, dated Dec. 2, 2010, 5 pages.

Behren et al., "Beeswax and other Non-Paraffin Waxes," Presented at NCA Technical Meeting, Jun. 19-20, 1991, 6 pages.

Bell et al., "Sperm Oil Replacements: Synthetic Wax Esters from Selectively Hydrogenated Soybean and Linseed Oils," Journal of the American Chemical Society, Jun. 1997, vol. 54, pp. 259-263.

Erhan et al. , "Drying Properties of Metathesized Soybean Oil," Journal of American Oil Chemists' Society, AOCS Press, vol. 74, No. 6, 1997, pp. 703-706.

Frahm, "Harvest Lights: The only soy-based candle, a bright idea," available at http://www.extension.uiuc.edu/~stratsoy/new/news/html/909166253,html, Oct. 23, 1998, 2 pages.

Mol, "Applications of Olefin Metathesis in Oleochemistry: An Example of Green Chemistry," Green Chemistry, Royal Society of Chemistry, Cambridge, GB, vol. 4, 2002, pp. 5-13.

Noller, Chemistry of Organic Compounds, W.B. Saunders Company, 2nd Ed., 1957, pp. 181 and 192.

Oliefabrik et al., "Paper coating", Research Disclosure Journal, Dec. 1996, 2 pages.

Orso, "New Use for Soybeans Has Bright Future," available at http://www.unitedsoybean.com/news/nr981014.htm, Oct. 14, 1998, 2 pages.

Rezaei, "Hydrogenated Vegetable Oils as Candle Wax," J. of the Am. Oil Chemists' Society, vol. 12, No. 79, pp. 1241-1247 (Dec. 2002).

Tao, "Development of Vegetable Lipid-based Candles," available at http://abe.www.ecn.purdue.edu/ABE/Research/research94/REPORT.94.Book_68.htmls, 1994, 2 pages.

In Business, "America's Shining Example of Sustainable Business," available at http://www.candleworks.org, Mar./Apr. 1998, 3 pages.

Pages from Bitter Creek Candle Supply, Inc., website (http://www.execpc.com/~bcsupply) now at http://www.candlesupply.com, available at least by Jun. 29, 2000, 9 pages.

Pages from Ecowax, Nature's Gift, Inc., website (http://nglwax.com/ecowax.htm), available at least by Jul. 5, 2000, 3 pages.

Pages from Heartland Candleworks website, available at www.candleworks.org, available at least by Feb. 11, 2000, 4 pages.

Purdue Agriculture News, Purdue May Agriculture & Natural Resources Package, available at http://purduenews.uns.purdue.edu/UNS/paks/agpak.digest.9605.html, May 1996, 3 pages.

Purdue News, "Purdue students put the 'happy' back into birthday candles," available at http://www.purdue.edu/UNS/html4ever/9611.Schweitzer.candles.html, Nov. 1996, 3 pages.

Purdue News, "Purdue students put the 'happy' back into birthday candles," available at http://www.purdue.edu/UNS/html4ever/9604.Schweitzer.candles.html, May 1996, 2 pages.

Purdue University School of Agriculture, 1998 Farm Progress Show, available at http://www.admin.ces.purdue.edu/anr/98fps/fpspix/930.html, 1998, 4 pages.

* cited by examiner

12

14

16

18

20

22

24

26

28

60

62

64

66

68

C823

C827

C627

C712

C697

C682

50 where

L = $PCy_3$, sIMes, Mes, Phobane
X = H, $NO_2$, $SO_2N(CH_3)_2$
$X_2$ = H, $N^+(C_2H_3)_2CH_3$
$X_3$ = H, Phenyl
R = H, alkyl, aryl, $CO_2Me$ sIMes Mes

52 where

L = $PCy_3$, sIMes, Mes, Phobane
L' = $PCy_3$, Phobane

Phobane

Surface profiles of three compression candles with various prill sizes.

PRILLED WAXES COMPRISING SMALL PARTICLES AND SMOOTH-SIDED COMPRESSION CANDLES MADE THEREFROM

CROSS-REFERENCE TO RELATED APPLICATIONS

This application is a continuation of International Application No. PCT/US2008/065395, filed May 30, 2008, which claims the benefit of U.S. Provisional Application having Ser. No. 60/932,338, filed May 30, 2007, and entitled PRILLED WAXES COMPRISING SMALL PARTICLES AND SMOOTH-SIDED COMPRESSION CANDLES MADE THEREFROM, the disclosures of which are incorporated herein by reference.

BACKGROUND

Candles can be made in various ways. Two of the common types of candles are poured candles and compression candles. Poured candles are made by melting a wax, pouring the melted wax into the desired shape candle mold, inserting a wick into the melting wax and then permitting the wax to harden. This process usually takes several hours, for example, 4-6 hours for large poured pillar candles, but results in a very smooth-sided, aesthetically pleasing candle. Poured candles generally are considered more desirable and, hence command higher prices than, for example, compression candles.

Compression candles may be made using wax particles, referred to as prills. The particles are compressed in a mold to create the candle. The process is typically made using a high-speed production process. The time to make a compression candle is seconds, for example, 15 seconds, compared to the hours required to make a poured candle. This results in lower production costs than traditional poured pillar candles. However, under normal compression conditions, the prills leave behind visual artifacts in the sides of the finished candles. For example, the prill borders are still visible in the sides of the finished candle, giving it a grainy appearance, which gives them inferior aesthetics to poured pillar candles, and may make them less desirable to consumers. As a result, compression candles typically sell for lower prices than poured pillar candles.

Attempts to improve the appearance of compression candles have included over-dipping the candles in molten wax; or by applying a pour over treatment inside a mold. The first method improves the aesthetics but adds cost and still does not match the aesthetics of poured pillar candles. In addition, over-dipping may require the shape of the candle to be altered to promote even coating and draining. For example, the top of the candle may be domed as opposed to flat. It is also difficult to over-dip candles with wide diameters, e.g., greater than about 3 inches.

The second method, applying a pour treatment inside a poured pillar mold to create a layer over the compressed candle, may improve aesthetics but adds substantial cost due to substantial increases in processing and cycle time.

BRIEF SUMMARY

The present invention relates to smooth-sided compression candles made from small particle prilled waxes. The particles comprise a hydrogenated natural oil wax where at least 75% of the wax particles have a particle size of less than 800 μm. The candle has a compressed core comprising a major portion of the prilled wax particles and a thermally fused outer layer comprising a minor portion of said prilled wax particles. The particles also may comprise a paraffin wax.

A method of making a smooth sided compression candle includes the steps of charging in a single step a mold with a quantity of prilled wax particles, comprising a hydrogenated natural oil, where at least about 75% particles have a particle size of less than 800 μm. The particles are compressed and the candle surface is heat treated to thermally fuse an outer layer of the compressed prilled wax particles.

DETAILED DESCRIPTION OF THE DRAWINGS AND THE PRESENTLY

Preferred Embodiments

Figure 1:
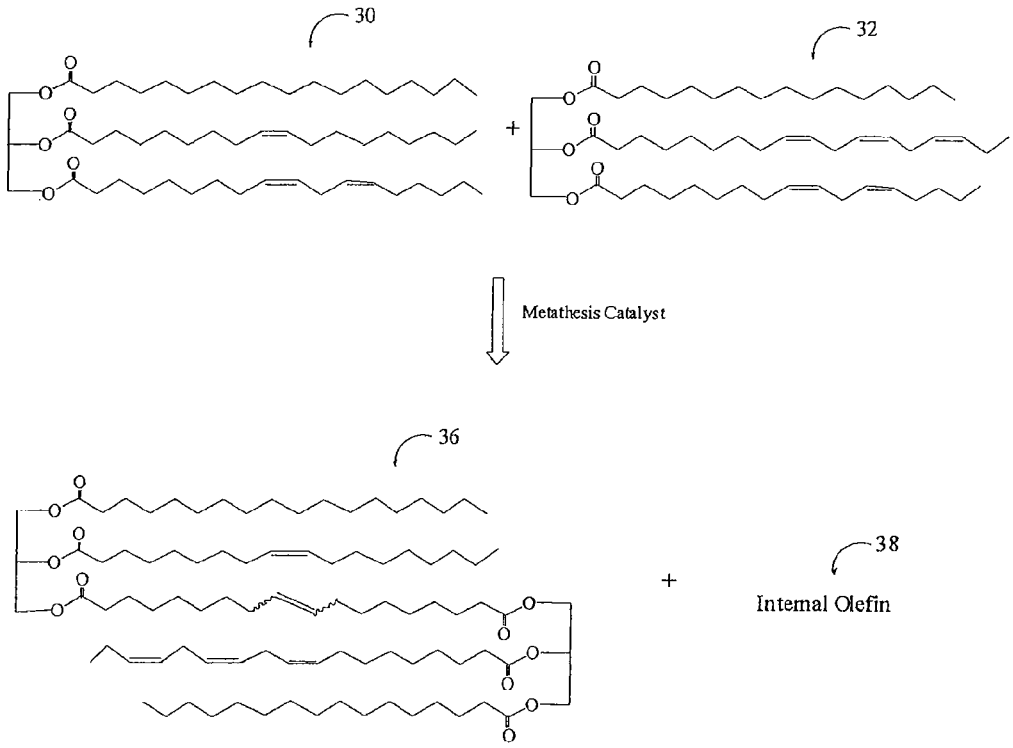
FIG. 1 is an exemplary metathesis reaction scheme.

As used herein, the term "natural oil" is intended to mean an oil derived from a plant or animal source.

As used herein, the term "particle size," unless otherwise indicated, is intended to mean the size of a particle that will just fit through a sieve having holes of that size.

As used herein, the term "relative density" is intended to mean the density, typically measured in g/ml, of the compressed candle or portion of a compressed candle, as the case may be, divided by the density of the individual particles making up the compressed candle or portion. As will be described below, the term "relative density" is one measure of the extent to which the prilled particles have been compressed to eliminate interstitial space therebetween.

Candles using prilled waxes may be formed using compression molding techniques. This process often involves forming the wax into a particulate form and then introducing the particulate wax into a compression mold. Prilled wax particles may be formed by first melting a wax composition in a vat or similar vessel. Optionally, additives such as coloring agents, scenting agents, UV stabilizers, and antioxidants may be added to the melted wax composition so they become incorporated into the prilled wax. The molten wax is then sprayed through a nozzle and into a cooling chamber. The finely dispersed liquid solidifies as it falls through the relatively cooler air in the chamber and forms prilled wax particles. The prilled particles, to the naked eye, appear to be spheroids or flakes about the size of grains of sand or smaller.

The particle size distribution (PSD) of a material is a list of values or a mathematical function that defines the relative amounts of particles present, sorted according to size. PSD is also known as grain size distribution. The method used to determine PSD is called particle size analysis, and the apparatus a particle size analyzer. As described here, wax compositions, such as compression candles may be manufactured using a prilled wax material, where a majority of wax particles have a particle size of about 800 μm or less, and preferably about 600 μm or less. Preferably, the wax particles have an average size not less than about 300 μm, more preferably not more than about 350 μm. Preferably, the wax particles have an average particle size not more than about 500 μm, more preferably not more than about 450 μm. The particle size of a wax particle is equal to the maximum cross-sectional dimension of the particle. The wax particles may be approximately spherical in shape such that the maximum dimension is equal to the diameter of the particle. Other shapes, such as flakes, also may be useful.

Small prilled wax particles may be attained by altering the spray nozzle design or sieving, or a combination thereof. After forming a prilled wax, the wax particles may optionally be passed through a sieve in order to screen out the large wax particles. In this way, the resulting prilled wax comprises a plurality of wax particles where a majority (or all) of the wax particles have a particle size of about 800 μm or less, and preferably about 600 μm or less. Although, ideally all particles in the prilled wax have a particle size of 800 μm or less, and preferably about 600 μm or less, the wax compositions may have a particle size distribution in which some of the particles are greater than about 600 to 800 μm. For example, no more than about 0.5% to about 25% of the particles in the prilled wax have a particle size greater than about 800 μm. In another embodiment, no more than about 0.5% to about 25% of the particles in the prilled wax have a particle size greater than about 600 μm. In specific examples, no than about 0, 0.5, 1, 2, 5, 10, 15, 20 and 25 percent of the particles have a particle size greater than about 800 μm. In yet other embodiments, no than about 0, 0.5, 1, 2, 5, 10, 15, 20 and 25 percent of the particles have a particle size greater than about 600 μm.

Surprisingly, it has been discovered that, as long as the number and size of particles greater than about 800 μm, and preferably 600 μm, is small, candles were produced having a smooth surface. Depending on the size and quantity of any particles above 600 μm, it may be desirable to combine this technique with heat treating of the surface of the candle, and/or with pressing to a high relative density, as described herein, to obtain a smooth sided candle. In addition, with candles having particle sizes below 600 μm, heat treating may impart further smoothness.

The distribution of the wax particles may be controlled in order to provide a bimodal distribution of particles. By bimodal, it is meant that the distribution of particle sizes can be described as being comprised of two populations or defined as two simple, unimodal distributions. A unimodal distribution can be described as a function with a single global maximum at some value where the function decreases monotonically for values departing from the maximum. One common example of a unimodal distribution is the so-called bell-shaped curve used to describe a random distribution in statistics.

Useful wax materials include any wax that is suitable for prilling and for making candles by compression. Examples of waxes include paraffin waxes, natural oil-based waxes, and mixtures thereof. In accordance with the invention, at least a portion of the prilled wax particle is a hydrogenated natural oil. The natural oils may be derived from vegetable or animal sources. It is noted that the term "vegetable," is intended to be interpreted relatively broadly, so as to include all plants. Representative examples of vegetable oils include canola oil, rapeseed oil, coconut oil, corn oil, cottonseed oil, olive oil, palm oil, peanut oil, safflower oil, sesame oil, soybean oil, sunflower oil, linseed oil, palm kernel oil, tung oil, castor oil and the like. Currently, soybean oil is preferred. Representative examples of useful animal fats include lard, tallow, chicken fat (yellow grease) or fish oil. Natural oils derived from algae also may be useful.

The natural oil is preferably hydrogenated to modify the physical properties of the oil such that it forms a wax. Representative techniques for hydrogenating natural oils are known in the art. For example, hydrogenation of certain vegetable oils is reported in Chapter 11 of Bailey, A. E.; Baileys Industrial Oil and Fat Products; Volume 2: Edible Oil & Fat Products: Oils and Oil Seeds; 5th Edition (1996) edited by Y. H. Hui (ISBN 0-471-59426-1).

The hydrogenated natural oil waxes may be fully hydrogenated or partially hydrogenated. As used herein, a "fully hydrogenated" refers to a vegetable oil that has been hydrogenated to achieve an iodine value (IV) of about 5 or less. As used herein the term "partially hydrogenated" refers to a vegetable oil that has been hydrogenated to achieve an Iodine Value of about 50 or less.

In an exemplary embodiment, the hydrogenated natural oil-based wax is fully hydrogenated, refined, bleached, and deodorized soybean oil (i.e., fully hydrogenated RBD soybean oil). Suitable fully hydrogenated RBD soybean oil can be obtained commercially from Cargill, Incorporated. (Minneapolis, Minn.).

In some embodiments, the wax may comprise a mixture of two or more natural oil-based waxes. For example, in some embodiments, the hydrogenated natural oil may comprise a mixture of fully hydrogenated soybean oil and partially hydrogenated soybean oil.

In many embodiments, the hydrogenated natural oil-based wax (e.g., hydrogenated soybean oil) is present in the wax in an amount ranging from about 50% to about 99% wax weight of the wax composition. By "wax weight" it is meant that the weight percentage is calculated on the basis of the wax component only, and is exclusive of additives such as fragrance, colorants, UV stabilizers, oxidizers, and the like. More typically, the hydrogenated natural oil-based wax is present in the wax in an amount ranging from about 50% to about 65% wax weight.

Useful wax compositions that may be used for the small particle prilled waxes are described in U.S. Pat. Nos. 7,217, 301, 7,192,457, 7,128,766, 6,824,572, 6,797,020, 6,773,469, 6,770,104, 6,645,261, and 6,503,285, all of which are incorporated in their entireties by reference here. Also useful are the waxes described in U.S. Patent Publication Nos. 2007/0039237, 2006/0272200, 2005/0060927, 2004/0221504, 2004/0221503, 2004/0088908, 2004/0088907, 2004/0047886, 2003/00110683, 2003/0017431, 2002/0157303, all of which are incorporated in their entireties by reference here. Also useful are waxes comprising metathesized natural oils such as described in WO 2006/076364, and incorporated by reference here in its entirety. In an exemplary embodiment, the wax comprises hydrogenated soybean oil, hydrogenated metathesized soybean oil, and paraffin wax.

In the preferred embodiments, the prilled wax particle comprise a hydrogenated metathesized natural oil, most preferably soy bean oil. The hydrogenated metathesized natural oil-based wax functions to control fat bloom in the wax. Hydrogenated metathesized natural oil-based wax is typically fat bloom resistant by itself, allowing it to be used as a bulk natural oil-based ingredient in formulations. In many embodiments, it is used at lower levels to control the fat bloom of other natural oil-based ingredients, such as hydrogenated soybean oil. A metathesized natural oil-based wax refers to the product obtained when one or more unsaturated polyol ester ingredient(s) are subjected to a metathesis reaction. Metathesis is a catalytic reaction that involves the interchange of alkylidene units among compounds containing one or more double bonds (i.e., olefinic compounds) via the formation and cleavage of the carbon-carbon double bonds. Metathesis may occur between two of the same molecules (often referred to as self-metathesis) and/or it may occur between two different molecules (often referred to as cross-metathesis). Self-metathesis may be represented schematically as shown in Equation I.

$$R^1{-}CH{=}CH{-}R^2 + R^1{-}CH{=}CH{-}R^2 \leftrightarrow R^1{-}CH{=}CH{-}R^1 + R^2{-}CH{=}CH{-}R^2 \quad \text{(I)}$$

where $R^1$ and $R^2$ are organic groups.

Cross-metathesis may be represented schematically as shown in Equation II.

$$R^1{-}CH{=}CH{-}R^2 + R^3{-}CH{=}CH{-}R^4 \leftrightarrow R^1{-}CH{=}CH{-}R^3 + R^1{-}CH{=}CH{-}R^4 + R^2{-}CH{=}CH{-}R^3 + R^2{-}CH{=}CH{-}R^4 + R^1{-}CH{=}CH{-}R^1 + R^2{-}CH{=}CH{-}R^2 + R^3{-}CH{=}CH{-}R^3 + R^4{-}CH{=}CH{-}R^4 \quad \text{(II)}$$

where $R^1$, $R^2$, $R^3$, and $R^4$ are organic groups.

When the unsaturated polyol ester comprises molecules that have more than one carbon-carbon double bond (i.e., a polyunsaturated polyol ester), self-metathesis results in oligomerization of the unsaturated polyol ester. The self-metathesis reaction results in the formation of metathesis dimers, metathesis trimers, and metathesis tetramers. Higher order metathesis oligomers, such as metathesis pentamers and metathesis hexamers, may also be formed by continued self-metathesis.

As a starting material to obtain a metathesized natural oil, metathesized unsaturated polyol esters are prepared from one or more unsaturated polyol esters. As used herein, the term "unsaturated polyol ester" refers to a compound having two or more hydroxyl groups wherein at least one of the hydroxyl groups is in the form of an ester and wherein the ester has an organic group including at least one carbon-carbon double bond. In many embodiments, the unsaturated polyol ester can be represented by the general structure (I):

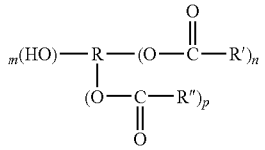

(I)

where n≥1;

m≥0;

p≥0;

(n+m+p)≥2;

R is an organic group;

R' is an organic group having at least one carbon-carbon double bond; and

R" is a saturated organic group.

In many embodiments of the invention, the unsaturated polyol ester is an unsaturated polyol ester of glycerol. Unsaturated polyol esters of glycerol have the general structure (II):

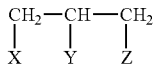

(II)

where —X, —Y, and —Z are independently selected from the group consisting of:

—OH; —(O—C(=O)—R'); and —(O—C(=O)—R");

where —R' is an organic group having at least one carbon-carbon double bond and —R" is a saturated organic group.

In structure (II), at least one of —X, —Y, or —Z is —(O—C(=O)—R').

In some embodiments, R' is a straight or branched chain hydrocarbon having about 50 or less carbon atoms (e.g., about 36 or less carbon atoms or about 26 or less carbon atoms) and at least one carbon-carbon double bond in its chain. In some embodiments, R' is a straight or branched chain hydrocarbon having about 6 carbon atoms or greater (e.g., about 10 carbon atoms or greater or about 12 carbon atoms or greater) and at least one carbon-carbon double bond in its chain. In some embodiments, R' may have two or more carbon-carbon double bonds in its chain. In other embodiments, R' may have three or more double bonds in its chain. In exemplary embodiments, R' has 17 carbon atoms and 1 to 3 carbon-carbon double bonds in its chain. Representative examples of R' include:

$$-(CH_2)_7CH{=}CH{-}(CH_2)_7{-}CH_3;$$

$$-(CH_2)_7CH{=}CH{-}CH_2{-}CH{=}CH{-}(CH_2)_4{-}CH_3; \text{ and}$$

$$-(CH_2)_7CH{=}CH{-}CH_2{-}CH{=}CH{-}CH_2{-}CH{=}CH{-}CH_2{-}CH_3.$$

In some embodiments, R" is a saturated straight or branched chain hydrocarbon having about 50 or less carbon atoms (e.g., about 36 or less carbon atoms or about 26 or less carbon atoms). In some embodiments, R" is a saturated straight or branched chain hydrocarbon having about 6 carbon atoms or greater (e.g., about 10 carbon atoms or greater or about 12 carbon atoms or greater. In exemplary embodiments, R" has 15 carbon atoms or 17 carbon atoms.

Sources of unsaturated polyol esters of glycerol include natural oils (e.g., vegetable oils, algae oils, and animal fats), combinations of these, and the like. Representative examples of vegetable oils include canola oil, rapeseed oil, coconut oil, corn oil, cottonseed oil, olive oil, palm oil, peanut oil, safflower oil, sesame oil, soybean oil, sunflower oil, linseed oil, palm kernel oil, tung oil, castor oil, tall oil, combinations of these, and the like. Representative examples of animal fats include lard, tallow, chicken fat, yellow grease, fish oil, combinations of these, and the like.

In an exemplary embodiment, the vegetable oil is soybean oil, for example, refined, bleached, and deodorized soybean oil (i.e., RBD soybean oil). Soybean oil is an unsaturated polyol ester of glycerol that typically comprises about 95% weight or greater (e.g., 99% weight or greater) triglycerides of fatty acids. Major fatty acids in the polyol esters of soybean oil include saturated fatty acids, for example, palmitic acid (hexadecanoic acid) and stearic acid (octadecanoic acid), and unsaturated fatty acids, for example, oleic acid (9-octadecenoic acid), linoleic acid (9,12-octadecadienoic acid), and linolenic acid (9,12,15-octadecatrienoic acid). Soybean oil is a highly unsaturated vegetable oil with many of the triglyceride molecules having at least two unsaturated fatty acids (i.e., a polyunsaturated triglyceride).

In exemplary embodiments, an unsaturated polyol ester is self-metathesized in the presence of a metathesis catalyst to form a metathesized composition. In many embodiments, the metathesized composition comprises one or more of: metathesis monomers, metathesis dimers, metathesis trimers, metathesis tetramers, metathesis pentamers, and higher order metathesis oligomers (e.g., metathesis hexamers). A metathesis dimer refers to a compound formed when two unsaturated polyol ester molecules are covalently bonded to one another by a self-metathesis reaction. In many embodiments, the molecular weight of the metathesis dimer is greater than the molecular weight of the individual unsaturated polyol ester molecules from which the dimer is formed. A metathesis trimer refers to a compound formed when three unsaturated polyol ester molecules are covalently bonded together by metathesis reactions. In many embodiments, a metathesis trimer is formed by the cross-metathesis of a metathesis dimer with an unsaturated polyol ester. A metathesis tetramer refers to a compound formed when four unsaturated polyol ester molecules are covalently bonded together by metathesis reactions. In many embodiments, a metathesis tetramer is formed by the cross-metathesis of a metathesis trimer with an unsaturated polyol ester. Metathesis tetramers may also be formed, for example, by the cross-metathesis of two metathesis dimers. Higher order metathesis products may also be formed. For example, metathesis pentamers and metathesis hexamers may also be formed.

Figure 1A:
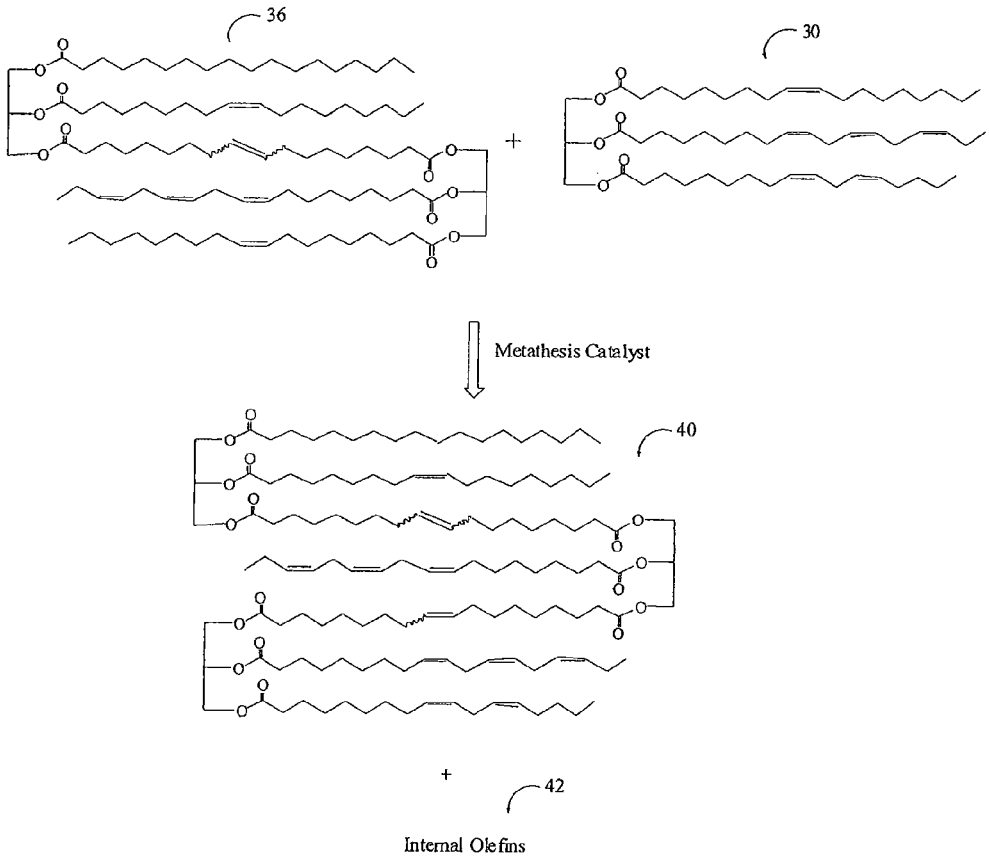
FIG. 1A is an exemplary metathesis reaction scheme.
Figure 1B:
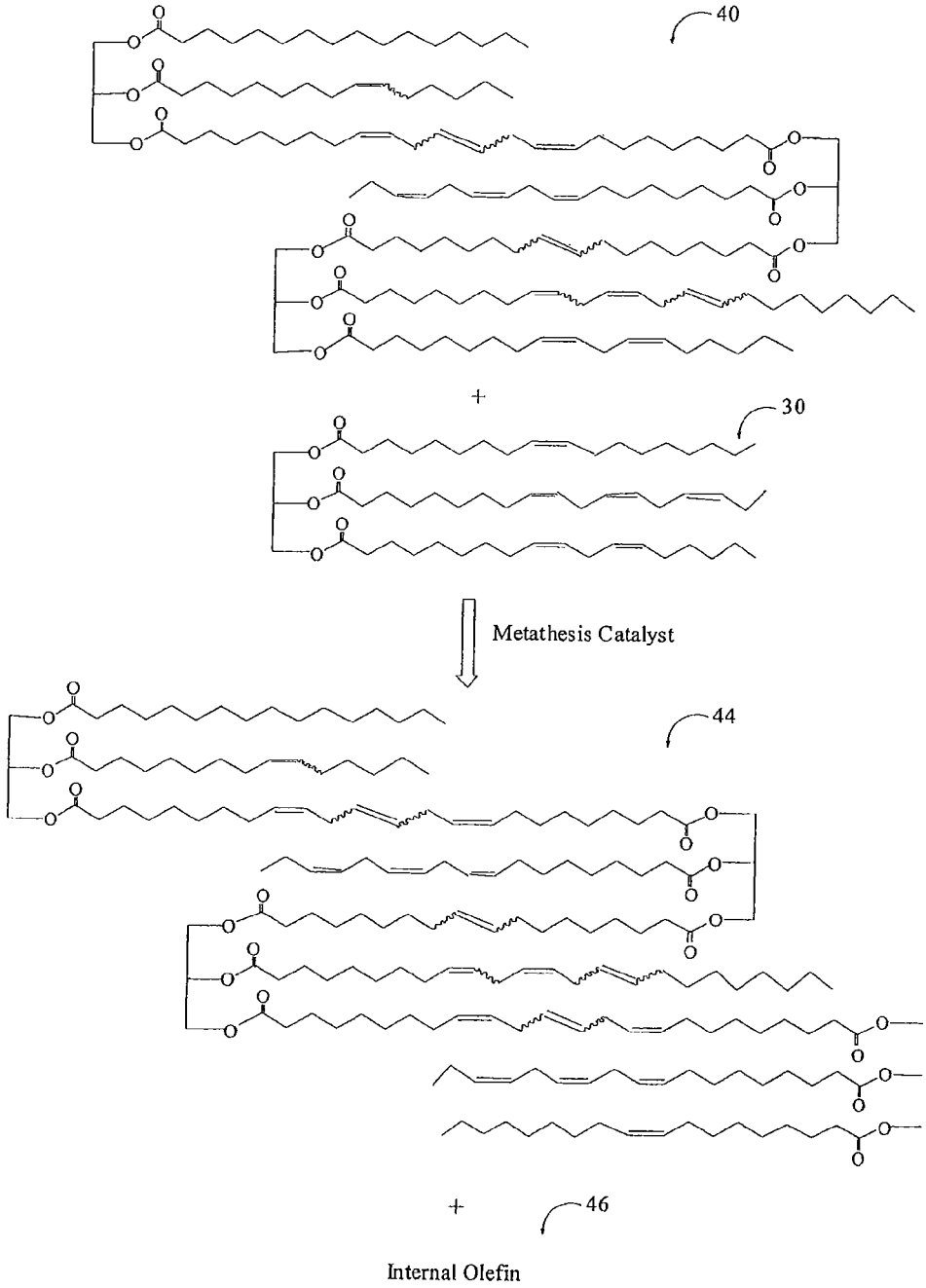
FIG. 1B is an exemplary metathesis reaction scheme.
Figure 1C:
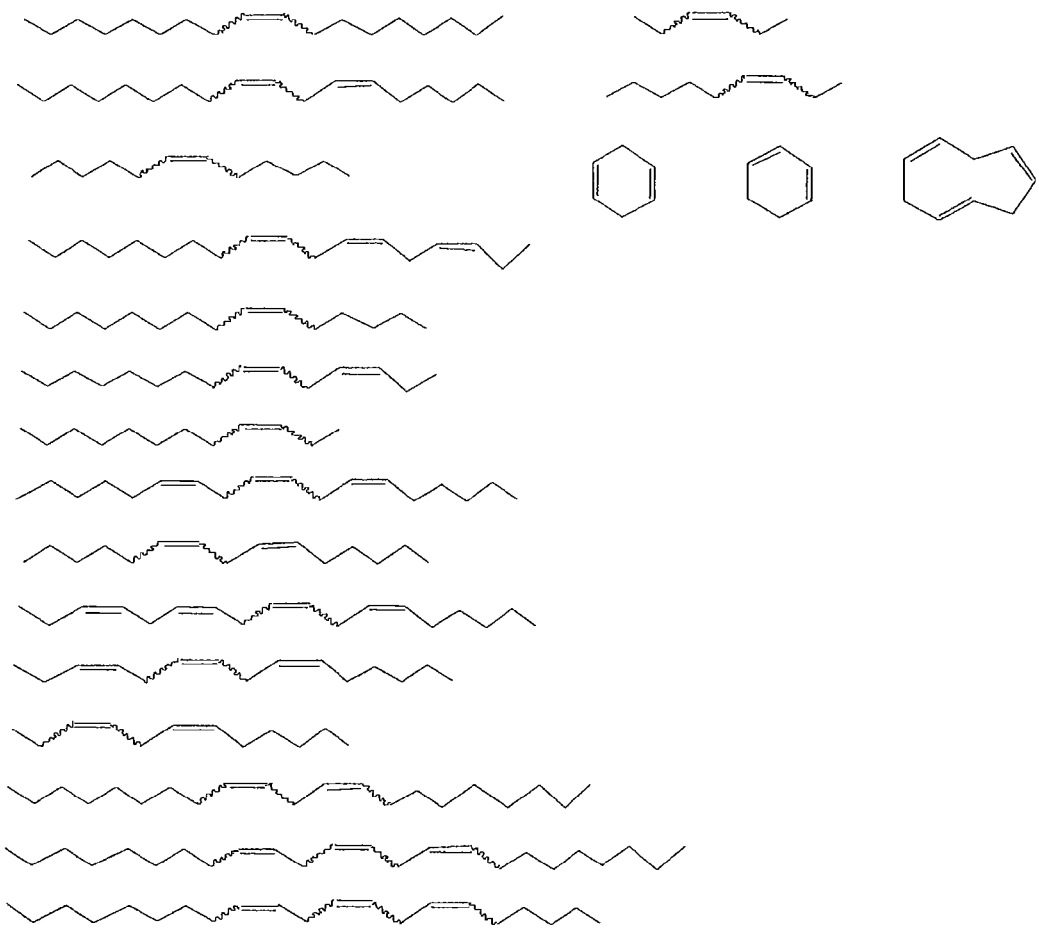
FIG. 1C displays certain internal and cyclic olefins that may be by-products of the metathesis reactions of FIGS. 1-1B.

An exemplary metathesis reaction scheme is shown in FIGS. 1-1B. As shown in FIG. 1, triglyceride 30 and triglyceride 32 are self metathesized in the presence of a metathesis catalyst 34 to form metathesis dimer 36 and internal olefin 38. As shown in FIG. 1A, metathesis dimer 36 may further react with another triglyceride molecule 30 to form metathesis trimer 40 and internal olefin 42. As shown in FIG. 1B, metathesis trimer 40 may further react with another triglyceride molecule 30 to form metathesis tetramer 44 and internal olefin 46. In this way, the self-metathesis results in the formation of a distribution of metathesis monomers, metathesis dimers, metathesis trimers, metathesis tetramers, and higher order metathesis oligomers. Also typically present are metathesis monomers, which may comprise unreacted triglyceride, or triglyceride that has reacted in the metathesis reaction but has not formed an oligomer. The self-metathesis reaction also results in the formation of internal olefin compounds that may be linear or cyclic. FIG. 1C shows representative examples of certain linear and cyclic internal olefins 38, 42, 46 that may be formed during a self-metathesis reaction. If the metathesized polyol ester is hydrogenated, the linear and cyclic olefins would typically be converted to the corresponding saturated linear and cyclic hydrocarbons. The linear/cyclic olefins and saturated linear/cyclic hydrocarbons may remain in the metathesized polyol ester or they may be removed or partially removed from the metathesized polyol ester using known stripping techniques. It should be understood that FIG. 1 provides merely exemplary embodiments of metathesis reaction schemes and compositions that may result therefrom.

The relative amounts of monomers, dimers, trimers, tetramers, pentamers, and higher order oligomers may be determined by chemical analysis of the metathesized polyol ester including, for example, by liquid chromatography, specifically gel permeation chromatography (GPC). For example, the relative amount of monomers, dimers, trimers, tetramers and higher unit oligomers may be characterized, for example, in terms of "area %" or weight %. That is, an area percentage of a GPC chromatograph can be correlated to weight percentage. In some embodiments, the metathesized unsaturated polyol ester comprises at least about 30 area % or weight % tetramers and/or other higher unit oligomers or at least about 40 area % or weight % tetramers and/or other higher unit oligomers. In some embodiments, the metathesized unsaturated polyol ester comprises no more than about 60 area % or weight % tetramers and/or other higher unit oligomers or no more than about 50 area % or weight % tetramers and/or other higher unit oligomers. In other embodiments, the metathesized unsaturated polyol ester comprises no more than about 1 area % or weight % tetramers and/or other higher unit oligomers. In some embodiments, the metathesized unsaturated polyol ester comprises at least about 5 area % or weight % dimers or at least about 15 area % or weight % dimers. In some embodiments, the metathesized unsaturated polyol ester comprises no more than about 25 area % or weight % dimers. In some of these embodiments, the metathesized unsaturated polyol ester comprises no more than about 20 area % or weight % dimers or no more than about 10 area % or weight % dimers. In some embodiments, the metathesized unsaturated polyol ester comprises at least 1 area % or weight % trimers. In some of these embodiments, the metathesized unsaturated polyol ester comprises at least about 10 area % or weight % trimers. In some embodiments, the metathesized unsaturated polyol ester comprises no more than about 20 area % or weight % trimers or no more than about 10 area % or weight % trimers. According to some of these embodiments, the metathesized unsaturated polyol ester comprises no more than 1 area % or weight % trimers.

in some embodiments, the unsaturated polyol ester is partially hydrogenated before being metathesized. For example, in some embodiments, the soybean oil is partially hydrogenated to achieve an iodine value (IV) of about 120 or less before subjecting the partially hydrogenated soybean oil to metathesis.

In some embodiments, the hydrogenated metathesized polyol ester has an iodine value (IV) of about 100 or less, for example, about 90 or less, about 80 or less, about 70 or less, about 60 or less, about 50 or less, about 40 or less, about 30 or less, about 20 or less, about 10 or less or about 5 or less.

Figure 2:
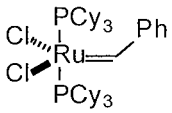
FIG. 2 is a figure showing exemplary ruthenium-based metathesis catalysts.
Figure 2:
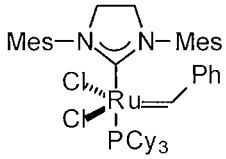
Figure 2:
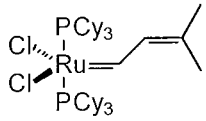
Figure 3:
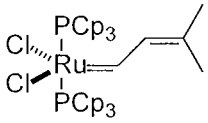
FIG. 3 is a figure showing exemplary ruthenium-based metathesis catalysts.
Figure 3:
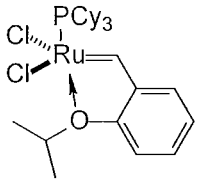
Figure 3:
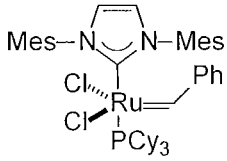
Figure 3:
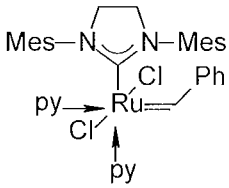
Figure 3:
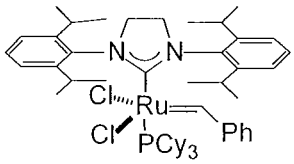
Figure 3:
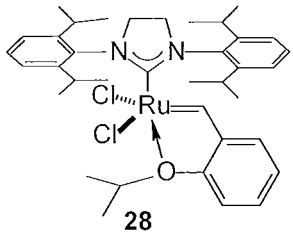
Figure 4:
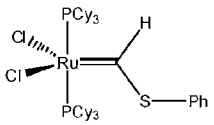
FIG. 4 is a figure showing exemplary ruthenium-based metathesis catalysts.
Figure 4:
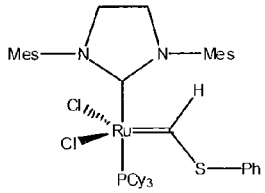
Figure 4:
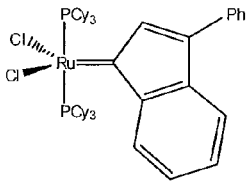
Figure 4:
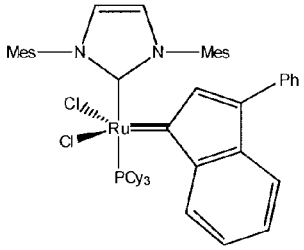
Figure 4:
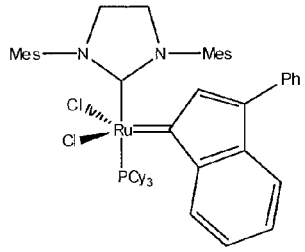
Figure 5:
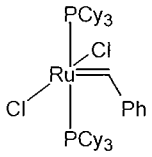
FIG. 5 is a figure showing exemplary ruthenium-based metathesis catalysts.
Figure 5:
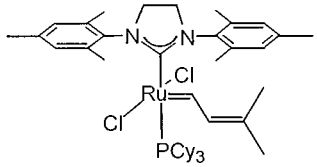
Figure 5:
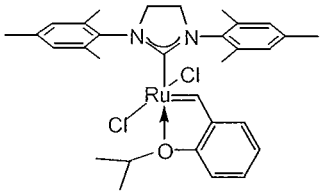
Figure 5:
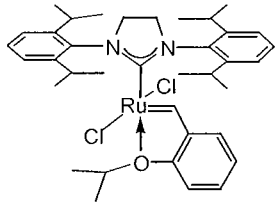
Figure 5:
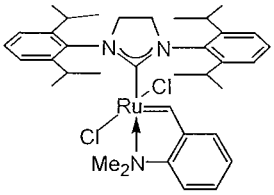
Figure 5:
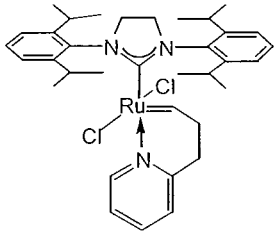
Figure 6:
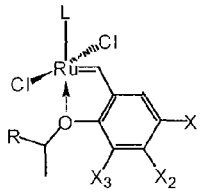
FIG. 6 is a figure showing exemplary ruthenium-based metathesis catalysts.
Figure 6:
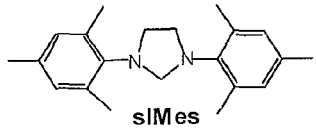
Figure 6:
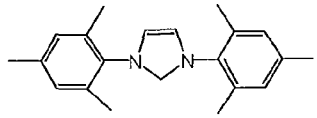
Figure 6:
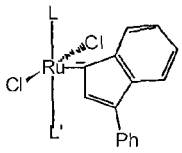
Figure 6:
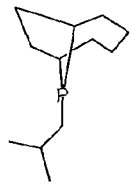

The self-metathesis of unsaturated polyol esters is typically conducted in the presence of a catalytically effective amount of a metathesis catalyst. The term "metathesis catalyst" includes any catalyst or catalyst system that catalyzes a metathesis reaction. Any known or future-developed metathesis catalyst may be used, alone or in combination with one or more additional catalysts. Exemplary metathesis catalysts include metal carbene catalysts based upon transition metals, for example, ruthenium, molybdenum, osmium, chromium, rhenium, and tungsten. Referring to FIG. 2, exemplary ruthenium-based metathesis catalysts include those represented by structures 12 (commonly known as Grubbs's catalyst), 14 and 16. Referring to FIG. 3, structures 18, 20, 22, 24, 26, and 28 represent additional ruthenium-based metathesis catalysts. Referring to FIG. 4, structures 60, 62, 64, 66, and 68 represent additional ruthenium-based metathesis catalysts. Referring to FIG. 5, catalysts C627, C682, C697, C712, and C827 represent still additional ruthenium-based catalysts. Referring to FIG. 6, general structures 50 and 52 represent additional ruthenium-based metathesis catalysts of the type reported in *Chemical & Engineering News*; Feb. 12, 2007, at pages 37-47. In the structures of FIGS. 2-6, Ph is phenyl, Mes is mesityl, py is pyridine, Cp is cyclopentyl, and Cy is cyclohexyl. Techniques for using the metathesis catalysts are known in the art (see, for example, U.S. Pat. Nos. 7,102,047; 6,794,534; 6,696,597; 6,414,097; 6,306,988; 5,922,863; 5,750,815; and metathesis catalysts with ligands in U.S. Publication No. 2007/0004917 A1). Metathesis catalysts as shown, for example, in FIGS. 2-5 are manufactured by Materia, Inc. (Pasadena, Calif.).

Additional exemplary metathesis catalysts include, without limitation, metal carbene complexes selected from the group consisting of molybdenum, osmium, chromium, rhenium, and tungsten. The term "complex" refers to a metal atom, such as a transition metal atom, with at least one ligand or complexing agent coordinated or bound thereto. Such a ligand typically is a Lewis base in metal carbene complexes useful for alkyne- or alkene-metathesis. Typical examples of such ligands include phosphines, halides and stabilized carbenes. Some metathesis catalysts may employ plural metals or metal co-catalysts (e.g., a catalyst comprising a tungsten halide, a tetraalkyl tin compound, and an organoaluminum compound).

An immobilized catalyst can be used for the metathesis process. An immobilized catalyst is a system comprising a catalyst and a support, the catalyst associated with the support. Exemplary associations between the catalyst and the support may occur by way of chemical bonds or weak interactions (e.g. hydrogen bonds, donor acceptor interactions) between the catalyst, or any portions thereof, and the support or any portions thereof. Support is intended to include any material suitable to support the catalyst. Typically, immobilized catalysts are solid phase catalysts that act on liquid or gas phase reactants and products. Exemplary supports are polymers, silica or alumina. Such an immobilized catalyst may be used in a flow process. An immobilized catalyst can simplify purification of products and recovery of the catalyst so that recycling the catalyst may be more convenient.

The metathesis process can be conducted under any conditions adequate to produce the desired metathesis products. For example, stoichiometry, atmosphere, solvent, temperature and pressure can be selected to produce a desired product and to minimize undesirable byproducts. The metathesis process may be conducted under an inert atmosphere. Similarly, if a reagent is supplied as a gas, an inert gaseous diluent can be used. The inert atmosphere or inert gaseous diluent typically is an inert gas, meaning that the gas does not interact with the metathesis catalyst to substantially impede catalysis. For example, particular inert gases are selected from the group consisting of helium, neon, argon, nitrogen and combinations thereof.

Similarly, if a solvent is used, the solvent chosen may be selected to be substantially inert with respect to the metathesis catalyst. For example, substantially inert solvents include, without limitation, aromatic hydrocarbons, such as benzene, toluene, xylenes, etc.; halogenated aromatic hydrocarbons, such as chlorobenzene and dichlorobenzene; aliphatic solvents, including pentane, hexane, heptane, cyclohexane, etc.; and chlorinated alkanes, such as dichloromethane, chloroform, dichloroethane, etc.

In certain embodiments, a ligand may be added to the metathesis reaction mixture. In many embodiments using a ligand, the ligand is selected to be a molecule that stabilizes the catalyst, and may thus provide an increased turnover number for the catalyst. In some cases the ligand can alter reaction selectivity and product distribution. Examples of ligands that can be used include Lewis base ligands, such as, without limitation, trialkylphosphines, for example tricyclohexylphosphine and tributyl phosphine; triarylphosphines, such as triphenylphosphine; diarylalkylphosphines, such as, diphenylcyclohexylphosphine; pyridines, such as 2,6-dimethylpyridine, 2,4,6-trimethylpyridine; as well as other Lewis basic ligands, such as phosphine oxides and phosphinites. Additives may also be present during metathesis that increase catalyst lifetime.

Any useful amount of the selected metathesis catalyst can be used in the process. For example, the molar ratio of the unsaturated polyol ester to catalyst may range from about 5:1 to about 10,000,000:1 or from about 50:1 to 500,000:1. In some embodiments, an amount of about 1 to about 10 ppm, or about 2 ppm to about 5 ppm, of the metathesis catalyst per double bond of the starting composition (i.e., on a mole/mole basis) is used.

The metathesis reaction temperature may be a rate-controlling variable where the temperature is selected to provide a desired product at an acceptable rate. The metathesis temperature may be greater than −40° C., may be greater than about −20° C., and is typically greater than about 0° C. or greater than about 20° C. Typically, the metathesis reaction temperature is less than about 150° C., typically less than about 120° C. An exemplary temperature range for the metathesis reaction ranges from about 20° C. to about 120° C.

The metathesis reaction can be run under any desired pressure. Typically, it will be desirable to maintain a total pressure that is high enough to keep the cross-metathesis reagent in solution. Therefore, as the molecular weight of the cross-metathesis reagent increases, the lower pressure range typically decreases since the boiling point of the cross-metathesis reagent increases. The total pressure may be selected to be greater than about 10 kPa, in some embodiments greater than about 30 kP, or greater than about 100 kPa. Typically, the reaction pressure is no more than about 7000 kPa, in some embodiments no more than about 3000 kPa. An exemplary pressure range for the metathesis reaction is from about 100 kPa to about 3000 kPa.

In some embodiments, the metathesis reaction is catalyzed by a system containing both a transition and a non-transition metal component. The most active and largest number of catalyst systems are derived from Group VI A transition metals, for example, tungsten and molybdenum.

As set forth above, in some embodiments, the unsaturated polyol ester is partially hydrogenated before it is subjected to the metathesis reaction. Partial hydrogenation of the unsaturated polyol ester reduces the number of double bonds that are available for in the subsequent metathesis reaction. In some embodiments, the unsaturated polyol ester is metathesized to form a metathesized unsaturated polyol ester, and the metathesized unsaturated polyol ester is then hydrogenated (e.g., partially or fully hydrogenated) to form a hydrogenated metathesized unsaturated polyol ester.

Hydrogenation may be conducted according to any known method for hydrogenating double bond-containing compounds such as vegetable oils. In some embodiments, the unsaturated polyol ester or metathesized unsaturated polyol ester is hydrogenated in the presence of a nickel catalyst that has been chemically reduced with hydrogen to an active state. Commercial examples of supported nickel hydrogenation catalysts include those available under the trade designations "NYSOFACT", "NYSOSEL", and "NI 5248 D" (from Englehard Corporation, Iselin, N.H.). Additional supported nickel hydrogenation catalysts include those commercially available under the trade designations "PRICAT 9910", "PRICAT 9920", "PRICAT 9908", "PRICAT 9936" (from Johnson Matthey Catalysts, Ward Hill, Mass.).

In some embodiments, the hydrogenation catalyst comprising, for example, nickel, copper, palladium, platinum, molybdenum, iron, ruthenium, osmium, rhodium, or iridium. Combinations of metals may also be used. Useful catalyst may be heterogeneous or homogeneous. In some embodiments, the catalysts are supported nickel or sponge nickel type catalysts.

In some embodiments, the hydrogenation catalyst comprises nickel that has been chemically reduced with hydrogen to an active state (i.e., reduced nickel) provided on a support. In some embodiments, the support comprises porous silica (e.g., kieselguhr, infusorial, diatomaceous, or siliceous earth) or alumina. The catalysts are characterized by a high nickel surface area per gram of nickel.

In some embodiments, the particles of supported nickel catalyst are dispersed in a protective medium comprising hardened triacylglyceride, edible oil, or tallow. In an exemplary embodiment, the supported nickel catalyst is dispersed in the protective medium at a level of about 22 weight % nickel.

In some embodiments, the supported nickel catalysts are of the type reported in U.S. Pat. No. 3,351,566 (Taylor et al.). These catalysts comprise solid nickel-silica having a stabilized high nickel surface area of 45 to 60 sq. meters per gram and a total surface area of 225 to 300 sq. meters per gram. The catalysts are prepared by precipitating the nickel and silicate ions from solution such as nickel hydrosilicate onto porous silica particles in such proportions that the activated catalyst contains 25 weight % to 50 weight % nickel and a total silica content of 30 weight % to 90 wt %. The particles are activated by calcining in air at 600° F. to 900° F., then reducing with hydrogen.

Useful catalysts having a high nickel content are described in EP 0 168 091, wherein the catalyst is made by precipitation of a nickel compound. A soluble aluminum compound is added to the slurry of the precipitated nickel compound while the precipitate is maturing. After reduction of the resultant catalyst precursor, the reduced catalyst typically has a nickel surface area of the order of 90 to 150 sq. m per gram of total nickel. The catalysts have a nickel/aluminum atomic ratio in the range of 2 to 10 and have a total nickel content of more than about 66% by weight.

Useful high activity nickel/alumina/silica catalysts are described in EP 0 167 201. The reduced catalysts have a high nickel surface area per gram of total nickel in the catalyst.

Useful nickel/silica hydrogenation catalysts are described in U.S. Pat. No. 6,846,772. The catalysts are produced by heating a slurry of particulate silica (e.g. kieselguhr) in an aqueous nickel amine carbonate solution for a total period of at least 200 minutes at a pH above 7.5, followed by filtration, washing, drying, and optionally calcination. The nickel/silica hydrogenation catalysts are reported to have improved filtration properties. U.S. Pat. No. 4,490,480 reports high surface area nickel/alumina hydrogenation catalysts having a total nickel content of 5% to 40% weight.

Commercial examples of supported nickel hydrogenation catalysts include those available under the trade designations "NYSOFACT", "NYSOSEL", and "NI 5248 D" (from Englehard Corporation, Iselin, N.H.). Additional supported nickel hydrogenation catalysts include those commercially available under the trade designations "PRICAT 9910", "PRICAT 9920", "PRICAT 9908", "PRICAT 9936" (from Johnson Matthey Catalysts, Ward Hill, Mass.).

Hydrogenation may be carried out in a batch or in a continuous process and may be partial hydrogenation or complete hydrogenation. In a representative batch process, a vacuum is pulled on the headspace of a stirred reaction vessel and the reaction vessel is charged with the material to be hydrogenated (e.g., RBD soybean oil or metathesized RBD soybean oil). The material is then heated to a desired temperature. Typically, the temperature ranges from about 50° C. to 350° C., for example, about 100° C. to 300° C. or about 150° C. to 250° C. The desired temperature may vary, for example, with hydrogen gas pressure. Typically, a higher gas pressure will require a lower temperature. In a separate container, the hydrogenation catalyst is weighed into a mixing vessel and is slurried in a small amount of the material to be hydrogenated (e.g., RBD soybean oil or metathesized RBD soybean oil). When the material to be hydrogenated reaches the desired temperature, the slurry of hydrogenation catalyst is added to the reaction vessel. Hydrogen gas is then pumped into the reaction vessel to achieve a desired pressure of $H_2$ gas. Typically, the $H_2$ gas pressure ranges from about 15 to 3000 psig, for example, about 15 psig to 90 psig. As the gas pressure increases, more specialized high-pressure processing equipment may be required. Under these conditions the hydrogenation reaction begins and the temperature is allowed to increase to the desired hydrogenation temperature (e.g., about 120° C. to 200° C.) where it is maintained by cooling the reaction mass, for example, with cooling coils. When the desired degree of hydrogenation is reached, the reaction mass is cooled to the desired filtration temperature.

The amount of hydrogenation catalysts is typically selected in view of a number of factors including, for example, the type of hydrogenation catalyst used, the amount of hydrogenation catalyst used, the degree of unsaturation in the material to be hydrogenated, the desired rate of hydrogenation, the desired degree of hydrogenation (e.g., as measure by iodine value (IV)), the purity of the reagent, and the $H_2$ gas pressure. In some embodiments, the hydrogenation catalyst is used in an amount of about 10 weight % or less, for example, about 5 weight % or less or about 1 weight % or less.

After hydrogenation, the hydrogenation catalyst may be removed from the hydrogenated product using known techniques, for example, by filtration. In some embodiments, the hydrogenation catalyst is removed using a plate and frame filter such as those commercially available from Sparkler Filters, Inc., Conroe Tex. In some embodiments, the filtration is performed with the assistance of pressure or a vacuum. In order to improve filtering performance, a filter aid may be used. A filter aid may be added to the metathesized product directly or it may be applied to the filter. Representative examples of filtering aids include diatomaceous earth, silica, alumina, and carbon. Typically, the filtering aid is used in an amount of about 10 weight % or less, for example, about 5 weight % or less or about 1 weight % or less. Other filtering techniques and filtering aids may also be employed to remove the used hydrogenation catalyst. In other embodiments the hydrogenation catalyst is removed using centrifugation followed by decantation of the product.

When present, the hydrogenated metathesized natural oil-based wax is typically present in a minor amount as compared to the hydrogenated natural oil-based wax. For example, the hydrogenated metathesized natural oil-based wax is typically present in an amount ranging from about 5% to about 80% wax weight of the wax composition, more typically from about 5% to about 30% wax weight. In many embodiments, the ratio of hydrogenated vegetable oil wax to hydrogenated metathesized natural oil-based wax ranges from about 10:1 to about 1:2.

Candle wax compositions of the invention also may comprise a paraffin wax. The paraffin wax is chosen to provide the wax composition of the invention with a desirable balance of properties. Paraffin wax comprises primarily straight chain hydrocarbons that have carbon chain lengths that range about C20 to about C40, with the remainder of the wax comprising isoalkanes and cycloalkanes.

The melting point of the paraffin wax typically ranges from about 130° F. to about 140° F., more typically ranging from about 130° F. to 135° F., and most typically ranging from about 132° F. to 134° F. Melting point can be measured, for example, according to ASTM D87.

One suitable paraffin wax is commercially available under the trade designation "PACEMAKER 37" (from Citgo Petroleum Corp., Tulsa Okla.). This paraffin wax is characterized in having a melting point of about 132° F. to about 134° F. (55.55 to 56.66° C.); an oil content of about 0.50 weight % or less; a needle penetration @77° F. (25° C.) of about 14; @100° F. (37.77° C.) of about 43; and @110° F. (43.33° C.) of about 96. Another suitable paraffin wax is commercially available under the trade designation "PACEMAKER 35" (from Citgo). This paraffin wax is characterized in having a melting point of about 130° F. to about 132° F. (54.44 to 55.55° C.); an oil content of about 0.50 weight % or less; a needle penetration @77° F. (25° C.) of about 14; @ 100° F. (37.33° C.) of about 57; and @110° F. of about 98. Yet another paraffin wax that may be suitable is commercially available under the trade designation "PACEMAKER 42" (from Citgo). This paraffin wax is characterized in having a melting point of about 134° F. to about 139° F. (56.66-59.44° C.); an oil content of about 0.50 weight % or less; a needle penetration @77° F. (25° C.) of about 13; @ 100° F. (37.77° C.) of about 21; and @ 110° F. (37.77° C.) of about 58.

In some embodiments, the paraffin wax is present in the wax composition of the invention in a minor amount, for example, less than 50% wax weight of the wax composition. In other embodiments, the paraffin wax is present in an amount ranging from about 20% to about 49% wax weight of the wax composition. In a preferred embodiment, the paraffin wax is present in an amount ranging from about 40% to about 49% wax weight, for example 45% wax weight.

The paraffin wax may be combined with natural oil wax and formed into prills and then compressed to form the compression candle. Alternatively, the paraffin wax and natural oil wax may be formed separately into prills and the paraffin wax prills and natural oil wax prills combined and then compressed to form the compression candle.

The prilled waxes having small particle sizes are formed into candles using compression techniques. The particulates can be introduced into a mold using a gravity flow hopper. The mold is typically made from steel; although, other materials of suitable strength may also be used. A physical press then applies between about 500 to 4000 pounds of pressure. In some embodiments, the pressure can be about 3500, 3000, 2500, 2000, 1500, 1200, 1000, 900, 800, 750, 700, 650, 600, 550 or less. The pressure applied may be at least about 500 pounds of pressure. The pressure can be applied from the top or the bottom or both. The formed candle can then be pushed out of the mold. The compression time typically ranges from about 1 to 20 seconds. In some embodiments, the compression time is 20 seconds or less, 15 seconds or less, 10 seconds or less, 5 seconds or less, or 2 seconds or less. In one embodiment, the compression time is 1 second. Equipment and procedures for wax powder compression are described in publications such as "Powder Compression Of Candles" by M. Kheidr (International Group Inc., 1990).

Figure 7:
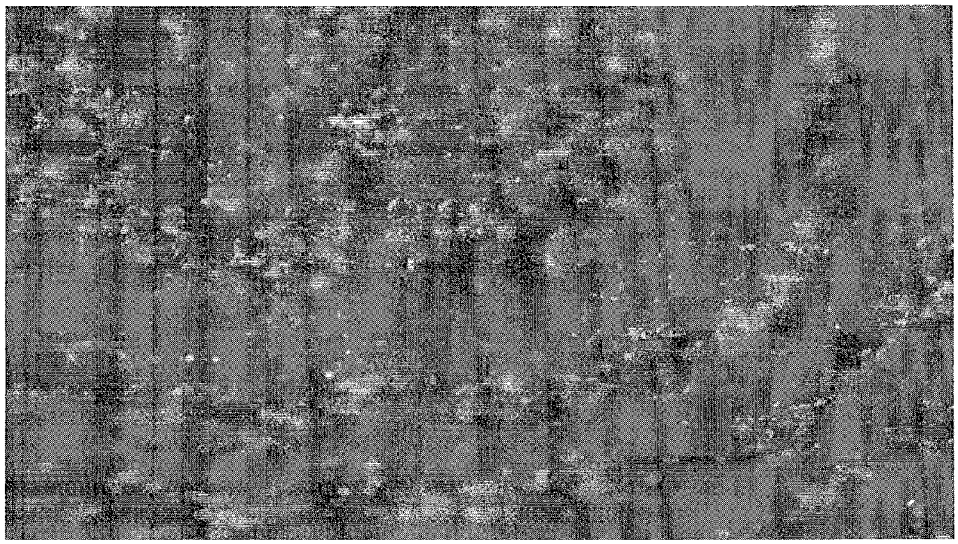
FIG. 7 is a photomicrograph of the surface of a compression candle of the invention made with a small particle size prilled wax (<600 μm).

Compression candles made with small prilled particles have a smooth sidewall with a surface that has an appearance that is similar to a poured pillar candle. During compression, the small prilled wax particles are pressed together to minimize interstitial spaces and are optionally melted at the outer surface in order to form a sidewall that is smooth and does not have the characteristic grainy texture that is typical of compression candles prepared with larger, less compressed, prilled waxes. FIG. 7 is a magnified photograph of the surface of a compression candle made of very small prilled particles (less than about 600 μm). The surface of the candle is smooth and uniform.

Figure 8:
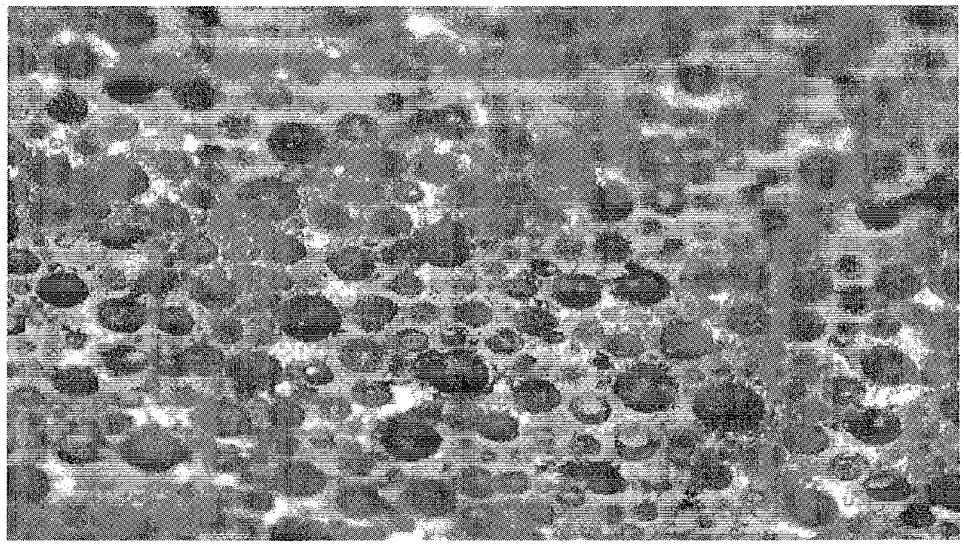
FIG. 8 is a photomicrograph of the surface of a compression candle made with a large particle size prilled wax (>600 μm).
Figure 9:
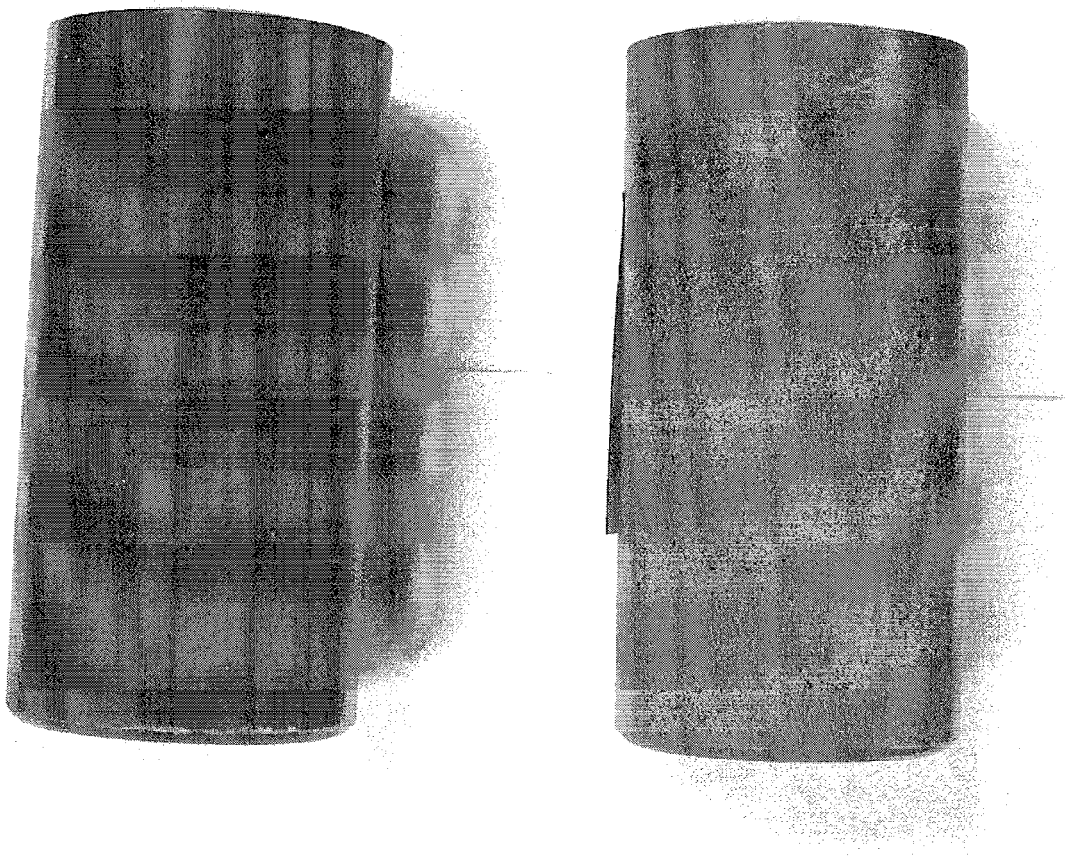
FIG. 9 is a photograph showing a candle of the invention (left) made with a small particle size prilled wax (<600 μm) positioned next to a candle made with a large particle size prilled wax (>600 μm) (right).

By contrast, FIG. 8 shows a magnified photo of the surface of a compressed candle made with a large particle size prilled wax (>600 μm). The surface of the candle has a grainy appearance containing numerous small voids and pits on the surface. Without magnification, the smooth-sided candle has an appearance that can be detected visually as different than the compression candles of the prior art. FIG. 9 is a photograph showing a compression candle of the invention (left) made with a small particle size prilled wax (<600 μm) positioned next to a candle made with a large particle size prilled wax (>600 μm). The candle made in accordance with the present invention has a smooth and glossy surface, whereas the other candle has a dull and pitted surface.

A variety of optional ingredients may be added to the wax compositions described here, including colorants, dyes, fragrances, UV stabilizers and anti-oxidants. A variety of pigments and dyes suitable for wax compositions, and in particular candles, are disclosed in U.S. Pat. No. 4,614,625, incorporated by reference here.

Colorants are commonly made up of one or more pigments and dyes. Colorants typically are included in an amount from about 0.001 to about 2 weight percent of the wax base composition. If a pigment is used, it is typically an organic toner in the form of a fine powder suspended in a liquid medium, such as mineral oil. A pigment that is in the form of fine particles suspended in vegetable oil, e.g., a natural oil derived from an oilseed source such as soybean or corn oil may be particularly useful. The pigment useful for candles typically is fine ground, organic toner. Several pigments may be blended to create custom colors.

Figure 10:
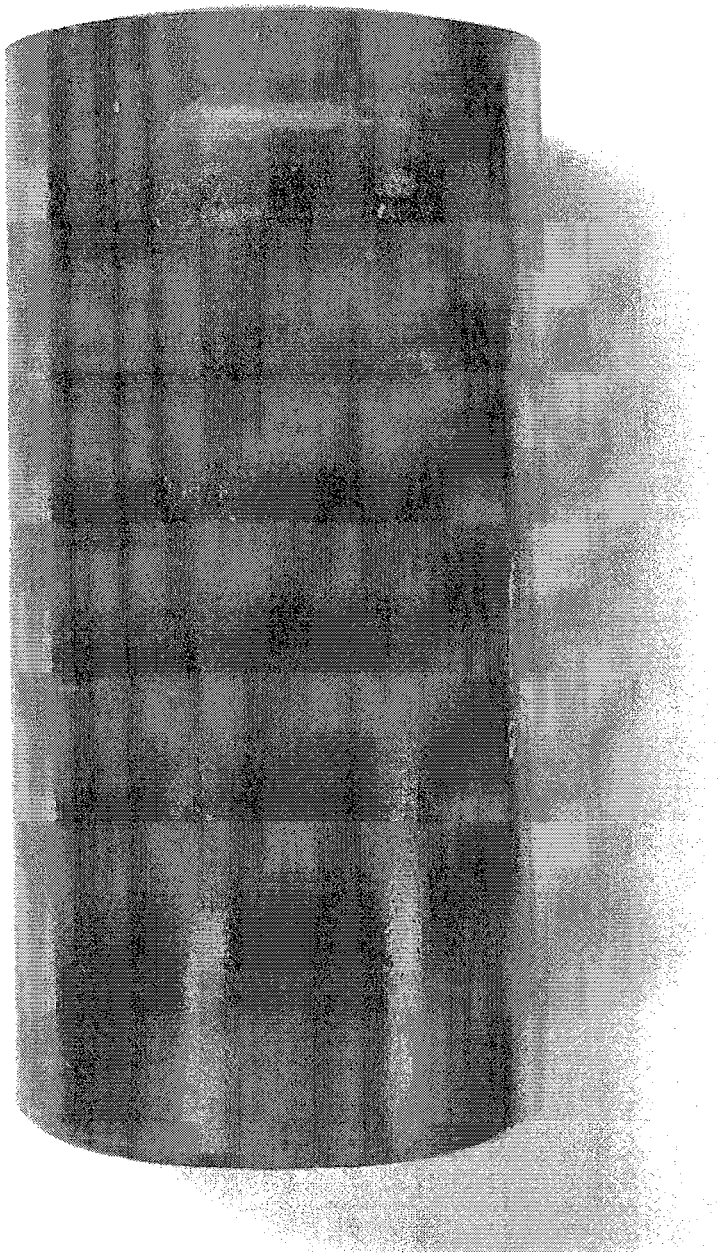
FIG. 10 is a photograph of a candle having a granite-looking appearance.

The prilled wax particles also may be colored with different colors, and the distribution of the different colored prilled wax particles in the candle may be used to provide a desirable appearance. For example, different colored particles may be used to create a candle having speckles, swirls, stripes, or other desired patterns. In one example, a granite-look candle is prepared by mixing or swirling several (e.g., 2-5) different colored prilled waxes prior to compression and then compressing the mixed colored prilled waxes to form a candle having a decorative granite-like appearance. An example of a granite-look candle is shown in FIG. 10.

Compression candles also may be post treated to provide an aesthetic effect to the outer surface of the candle. This may be accomplished, for example, by quickly chilling the candle after it is removed from the compression mold in order to introduce a crackled or distressed look to the outer surface.

Figure 11:
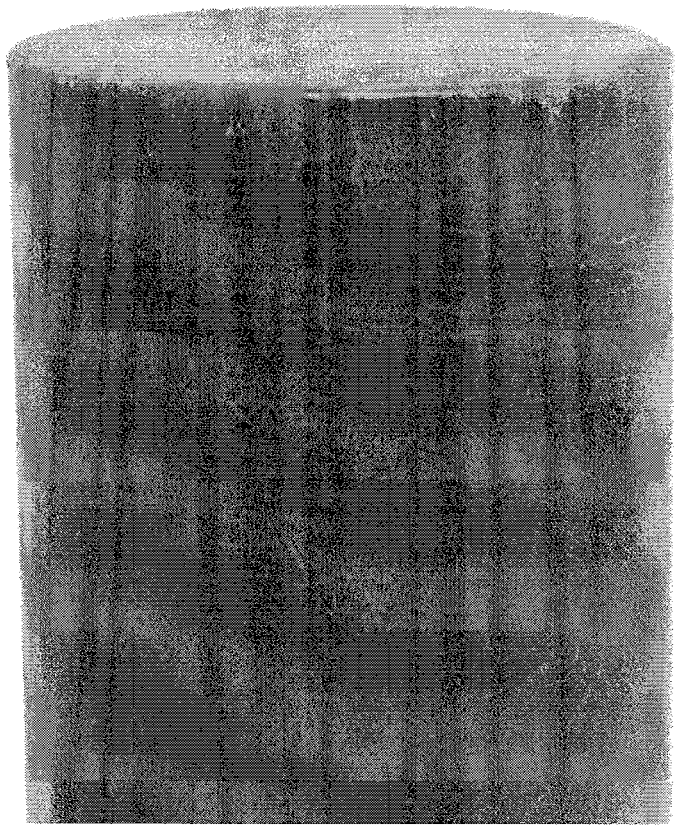
FIG. 11 is a photograph of a candle having a crackled or distressed surface finish.

Chilling may be accomplished by dipping the compression formed candle in cold water or contacting the surface of the candles with ice. An example of a candle displaying a crackled or distressed look is shown in FIG. 11.

In yet another example, a decorative look may be imparted to the outer surface of a compression candle by treating the surface with a wire brush or other implement to form a texture on the surface. The texture may be formed in a vertical fashion (i.e., parallel to the length of the candle) or horizontal fashion (i.e., around the circumference of the candle).

Compression candles made as described here may be cylindrical, oval, square, triangular, octagonal, rectangular, hexagonal, or any shape, in cross-section. The candles typically have a diameter between about 0.25 and about 8 inches, more typically between about 1.5 and 6 inches. The candles of the invention typically have a height between about 1 and about 9 inches, more typically between about 3 and 9 inches.

Most preferably, the candle of the present invention is made in the style known as a "pillar candle," i.e. a cylindrical shaped candle that is thick enough to stand upright on its own.

Fragrances also are commonly incorporated in wax compositions. The fragrance may be an air freshener, an insect repellant or a combination thereof. Exemplary liquid fragrances include one or more volatile organic compounds, which are available from perfumery suppliers such as IFF, Firmenich Inc., Takasago Inc., Belmay, Noville Inc., Quest Co., and Givaudan-Roure Corp. Most conventional fragrance materials are volatile essential oils.

Wicks utilized for the candles of the invention are available commercially. Those skilled in the art of candle making will be able to readily determine appropriate wick materials and suppliers based upon the wax used, the desired rate of burn, and the like.

The compression mold that is used to form the candles is preferably heated in order to improve the smoothness of the outer surface of the compression candles. The heated surface of the mold functions to melt a thin layer at the outer surface of the candle thereby creating a smooth melt-formed layer on the surface of the candle. The smooth melt-formed layer helps to reduce any graininess that may otherwise be present on the outer wall of the candle. When heat is used along with a prilled wax having small particle size (e.g., less than 800 μm), a candle having a very smooth outer surface can be manufactured using compression molding.

The smooth melt-formed layer is formed by heating the compression mold or other device to heat treat the candle to a temperature of between about 29 and about 49° C., and preferably between about 34 and 45° C. The desired temperature may depend on the particular wax composition and the temperature at which it begins to melt. In one embodiment, the temperature applied to the candle is between about 29° C. and 38° C. Preferably, the temperature is about 49° C. or less, 45° C. or less, 40° C. or less, or 38° C. or less. Also, preferably, the temperature is 29° C. or greater. The smooth melt-formed layer is a thin layer having a thickness of less than about 2 mm, preferably less than about 1.5 mm and more preferably less than about 1 mm.

In addition, the formation of a very smooth surface is preferably also enhanced by compressing the prilled wax to a high density. However, potential for de-lamination defects in the candle increase with compression to higher densities. Lamination defects are horizontal cracks that sometimes form in a compression candle, in particular, when a prilled wax is compressed to a high density. These defects negatively impact both the strength and the visual appearance of the compression candle that is formed. In accordance with the invention, lamination defects may be mitigated by one or more techniques including (a) operating the candle press at slower than normal speed; (b) forming compression candles in a horizontal rather than vertical orientation; (c) the use of small particle sizes; (d) the use of broader or bimodal particle size distributions; and/or (e) the use of waxes comprising a mixture of vegetable oil wax and paraffin wax blends.

By compressing the small prilled wax particles to a high density, the interstitial space present between prilled wax particles is minimized. For example, the prilled wax may be compressed to a relative density of about 0.93 or greater, for example, about 0.93 to about 0.995, or about 0.95 to about 0.995. As a practical matter a high relative density only needs to be achieved on the sidewall of the candle, and not the entire interior of the candle, to achieve the desired surface aesthetics. By comparison, a poured candle would have a relative density of about 1.0 because there are no interstitial spaces (excluding any air bubbles, which may have been inadvertently trapped during the solidification process). A high density may be attained in the compression candle of the present invention by increasing the pressure that is applied to the prilled wax by the pistons in the candle compression apparatus. The attainment of a high density also may be promoted by (a) using a prilled wax with a very small particle size, such as those described here; and (b) using a prilled wax having a broad or bimodal particle size distribution.

EXAMPLES

Examples 1-3

The following examples were prepared as described below. Examples 1 and 2 both produced typical compression candles having an undesirable, grainy appearance. These examples included two different particle size distributions, both of which contribute to a grainy-looking candle. In contrast, Example 3 has a dramatically different particle size distribution and produces a smooth-sided candle.

Example 1

29.05 kg (63.91 lbs) of a wax composition including 55% vegetable-based wax and 45% paraffin-based wax was melted in a heated vessel. The vegetable portion was a 4:1 blend of S-155 (fully hydrogenated vegetable oil) and HMSBO (fully hydrogenated metathesized vegetable oil). The paraffin portion is a 2:1 mixture of Citgo PaceMaker 45 and Citgo Pacemaker 30, both commercially available from Citgo Corporation. 3 wt % fragrance (Arylessence Snickerdoodle) and 30 grams of purple dye from French Chemical also were added.

The temperature was raised to 80° C. (176 F) and the melted wax was transferred to a feed pot and seed vessel. The feed pot was pressurized to 50 psig and the transfer valve at the bottom of the feed pot was opened to allow wax to flow to the spray nozzle. Wax was sprayed at 80° C. into the cooling chamber. Air flow to the cooling chamber was approximately 1500 cfm. Inlet air temp was about 60° F. The droplets of wax partially solidified into spherical shapes as they fell through the chamber. Upon impact at the bottom, some particles may have deformed and flattened—changing from a spherical shape to a flat flake, although in this experiment, most of the particles (>90%) retained their spherical shape.

The particle size of the particles were measured using sieves having openings of varying sizes. The particle size distribution for the particles in this example is shown in Table 1, below. In this example, over 23% had particle sizes greater than 850 μm, about 33% were between 600 and 850 μm, and the remainder were below 600 μm.

Figure 12:
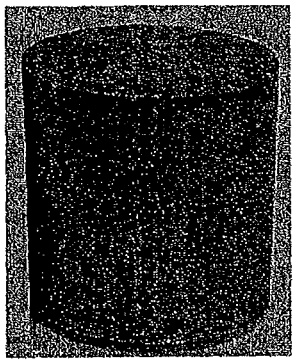
FIG. 12 is a photograph of a compression candle made with prilled wax particles where over 23 percent of the particles were greater than 850 μm, 33% were between 600 μm and 850 μm, the remainder were smaller than 600 μm.

The prills were collected and allowed to cool to room temperature. The prills were loaded into a feed hopper on a hydraulic candle press. The press was set to 775 psi using 3" diameter compression heads. The fill height was adjusted to 5.5 inches. 308 grams of the prilled wax were charged into the compression mold and the compression cycle was commenced. The top compression head was moved down 0.5 inches and the bottom compression head was moved up from the 6 inch mark to the 3.5 inch mark and a 1 second dwell time was applied. The candle was ejected from the mold. The resulting candle measured 3 and ⅛ inches tall and had a relative density of 0.91. Relative density is calculated by dividing the average bulk density of the candle by the density of the individual prill of wax. This candle had the grainy appearance as shown in FIG. 12.

Example 2

250 lbs of the wax composition of Example 1 was melted in a heated vessel. 2 wt % fragrance (Arylessence Vanilla) and a small quantity of dye was added. The temperature was raised to 71° C. (160° F.). The wax was sprayed into the air using a recirculation pump and a spray bar and was directed in an arch so that it landed on the top of the cooling drum. 55° F. water was flowing inside the drum. Ambient air temperature was about 84° F. The wax droplets partially solidified as they fell through the air and finished solidifying on the cooling drum. The particles were then scraped with a knife from the surface of the drum. The particles were cooled to room temperature.

The particle size of the particles of this example were measured using sieves having openings of varying sizes as shown in Table 1. Table 1 shows the percentage of particles left on the various mesh sieves. The particle size distribution for the particles in this example is shown in Table 1, below. In this example, about 72% had particle sizes greater than 850 μm.

Figure 13:
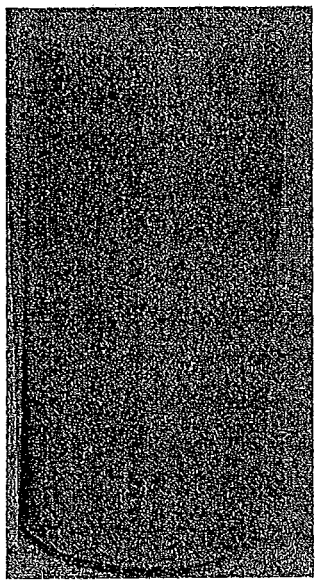
FIG. 13 is a photograph of a compression candle made with prilled wax particles where over 72 percent of the particles were greater than 850 μm.

The prilled particles were fed into a feed hopper as described above and the hydraulic press was set to 800 psi using 3" diameter compression heads. The fill height was adjusted to 10.5 inches. 611.76 grams of wax was charged into the compression mold. The top compression head was moved down 0.5 inches and the bottom compression head was moved up from the 10.5 inch mark to the 6.5 inch mark. A 2 second dwell time was applied. The resulting 6¼ inch candle was ejected from the mold. The candle had a relative density of about 0.91 and is grainy in appearance as shown in FIG. 13.

Example 3

Figure 14:
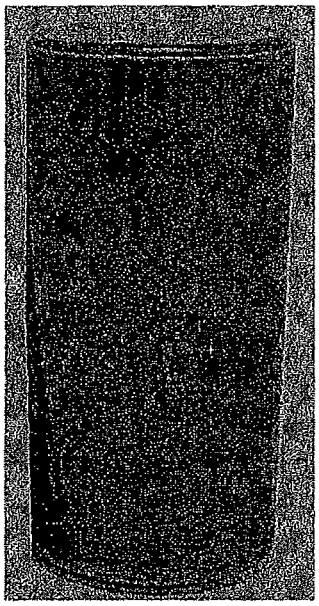
FIG. 14 is a photograph of a compression candle where 100 percent of the particles were less than 600 μm.

The prills from the first example were sieved to remove all particles larger than 600 microns. The prills were loaded into a feed hopper on a hydraulic candle press. The press was set to 775 psi using 3" diameter compression heads. The fill height was adjusted to 9.5 inches. The top compression head was moved down 1 inch and the bottom compression head was moved up from the 9.5 inch mark to the 7 inch mark. A ten second dwell time was applied. The resulting 6¼ inch candle was ejected from the mold. The candle was smooth in appearance as shown in FIG. 14. A compression candle made in this manner would have a relative density of about 0.97.

TABLE 1

Particle Size Distributions

| Mesh Opening (Microns) | Example 1 % Sample Above Sieve | Example 2 % Sample Above Sieve | Example 3 % Sample Above Sieve |
|---|---|---|---|
| 2000 | 0.12 | 4.1 | 0.0 |
| 1400 | 3.45 | 22.7 | 0.0 |
| 1180 | 2.61 | 10.3 | 0.0 |
| 1000 | 5.04 | 13.6 | 0.0 |
| 850 | 12.29 | 21.8 | 0.0 |
| 710 | 10.37 | 14.1 | 0.0 |
| 600 | 23.02 | 8.3 | 0.0 |
| 0 | 43.11 | 5.1 | 100.0 |

Examples 4-6

Roughness Testing

The surface of the candles can be characterized by surface characterization techniques known in the art. Surface profilometers are used to measures surface profiles, roughness, waviness and other finish parameters. A profilometer can measure small surface variations in vertical stylus displacement as a function of position. A typical profilometer can measure small vertical features ranging in height from 10 to 65,000 nanometers. The height position of the diamond stylus generates an analog signal which is converted into a digital signal stored, analyzed and displayed. The radius of diamond stylus ranges from 5 μm to about 25 μm, and the horizontal resolution is controlled by the scan speed and scan length. There is a horizontal broadening factor which is a function of stylus radius and of step height. This broadening factor is added to the horizontal dimensions of the steps. The stylus tracking force is factory-set to an equivalent of 50 milligrams (~500 mN).

Roughness may be measured from maximum peak-to-valley height, which is the absolute value between the highest and lowest peaks, as calculated from the following formula.

$$R_t = R_p + R_v$$

Where $R_t$ is the maximum range in surface height, $R_p$ is the maximum peak height and $R_v$ is the absolute value of the lowest peak (or valley).

Average roughness ($R_a$), as determined by the formula below, is defined as the arithmetic mean of the departures of the roughness profile from the mean line. $R_a$ is measured with a profilometer probe. It is usually recorded in microinches or micrometers. In general, the lower the $R_a$, the smoother the finish.

$$R_a = \frac{1}{L}\int_0^L |z(x)|dx$$

Where L is the length of the measurement and z(x) is the surface profile (displacement is the z direction as a function of x.

Root-mean-square (rms) roughness also may be used to measure roughness, according to the formula below. The average of the measured height deviations taken within the evaluation length or area and measured from the mean linear surface. $R_q$ is the rms parameter corresponding to $R_a$.

$$R_q = \sqrt{\frac{1}{L}\int_0^L z^2(x)dx}$$

Where L is the length of the measurement and z(x) is the surface profile (displacement is the z direction as a function of x).

Three compression candles were measured for their average roughness. The sample candles were measured with a contact profilometer from Alpha-Step IQ with a tip radius is 5 micron).

Example 4 is a compression candle made from prilled wax particles where the particle sizes were less than 600 μm and a heated mold was used. Example 5 is a compression candle made from prilled wax particles where the particle sizes were less than 600 μm and an unheated mold was used. Example 6 is a compression candle made from prilled wax particles where the particle sizes were between 600 μm and 2000 μm and an unheated mold was used.

Figure 15:
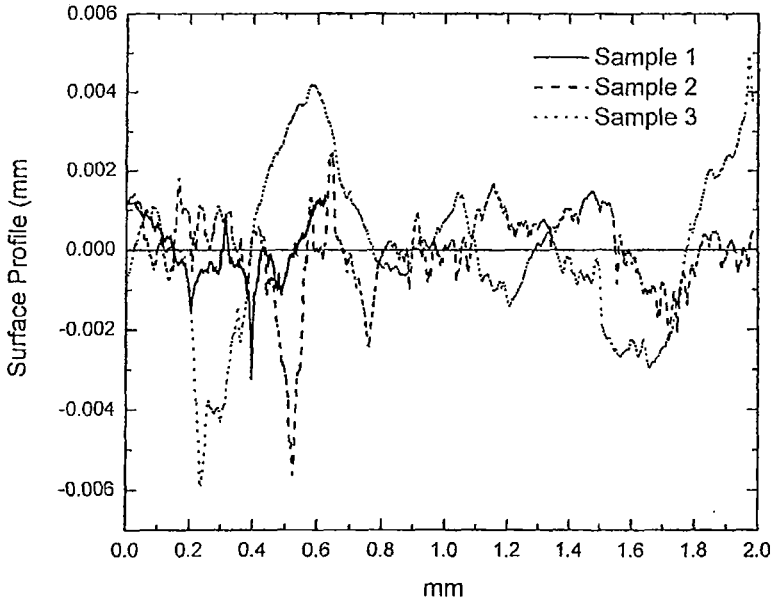
FIG. 15 is a graph showing the results of roughness testing of various candles.

FIG. 15 graphically depicts the results of the measurements and Table 2 shows the average roughness of the surfaces of the sample candles. The lower the number, the smoother the surface of the candle.

TABLE 2

Calculated surface roughness values

| Example | $R_t$ (μm) | $R_a$ (μm) | $R_q$ (μm) |
|---|---|---|---|
| Example 4 | 4.49 | 0.63 | 0.76 |
| Example 5 | 8.07 | 0.77 | 1.08 |
| Example 6 | 10.73 | 1.52 | 2.00 |

In addition, the surface may be characterized using a gloss meter. As the surface becomes smoother, the measured gloss level increases. The "glossiness" or visual smoothness of the article is an improvement over the dull or matte finish on typical candles formed previously by compression. Typically, the difference between gloss and matte can be attributed to the surface roughness as it impacts the reflection of light. If the surface features have roughness with length scales small compared to the wavelength of light, one observes a coherent reflection or specular reflection. For example a focused light beam will reflect off of an optically smooth service in a manner obeying the so-called Law of Reflection, that is the angle of incident light will be equal to the angle of the reflected light where the angles are defined with respect to the surface normal. Conversely, focused light directed to an optically rough surface will reflect the light with a scattered distribution in what is called a diffuse reflection. This diffuse reflection is what is referred to as a matte finish. A more detailed discussion can be found in Hecht (*Optics*, Addison Wesley, 2002, section 4.3). The intensity of reflected light and as a function of the angle of reflection can be used as measures of gloss versus matte.

Surface roughness may also be characterized by microscopic examination of the surface. This examination may include measuring the size of the features on the surface of the candle. For example, the microscopic examination may include measuring the size of interstitial spaces present between adjacent compressed prilled wax particles at the surface. Compression candles of the invention have surface topography that compares favorably with smoothness of poured candles.

It is intended that the foregoing detailed description be regarded as illustrative rather than limiting, and that it be understood that it is the following claims, including all equivalents, that are intended to define the spirit and scope of this invention.

The invention claimed is:

1. A candle comprising:

prilled wax particles, said particles comprising a blend of a hydrogenated natural oil and a hydrogenated metathesized natural oil, wherein the ratio of the hydrogenated natural oil to the hydrogenated metathesized natural oil ranges from about 10:1 to about 1:2, and further wherein at least about 75% of said particles have a particle size of less than 800 μm;

a compressed core comprising a major portion of said prilled wax particles;

a thermally fused outer layer comprising a minor portion of said prilled wax particles; and a wick.

2. The candle of claim 1 wherein the outer layer has an average thickness of about 2 mm or less.

3. The candle of claim 1 wherein the prilled wax particles further comprise paraffin.

4. The candle of claim 3 wherein the paraffin wax comprises less than about 50% wax weight of the wax composition.

5. The candle of claim 1, where at least about 90% of the prilled wax particles have a particle size less than about 800 μm.

6. The candle of claim 1, where at least about 75% of the prilled wax particles have a particle size less than about 600 μm.

7. The candle of claim 6, where at least about 90% of the prilled wax particles have a particle size less than about 600 μm.

8. The candle of claim 1, where the prilled wax particles have an average particle size between 300 μm and 500 μm.

9. The candle of claim 1 wherein the compressed core has a relative density of at least 0.93.

10. The candle of claim 1, wherein the hydrogenated natural oil is derived from a vegetable source, selected from the group consisting of canola oil, rapeseed oil, coconut oil, corn oil, cottonseed oil, olive oil, palm oil, peanut oil, safflower oil, sesame oil, soybean oil, sunflower oil, linseed oil, palm kernel oil, tung oil, castor oil, tall oil, and combinations thereof.

11. The candle of claim 1, wherein the hydrogenated metathesized natural oil is hydrogenated metathesized soybean oil.

12. A method of making a candle comprising the steps of:

charging in a single step a mold with a quantity of prilled wax particles, said particles comprising a blend of a hydrogenated natural oil and a hydrogenated metathesized natural oil, wherein the ratio of the hydrogenated natural oil to the hydrogenated metathesized natural oil ranges from about 10:1 to about 1:2, and further wherein at least about 75% particles have a particle size of less than 800 μm;

compressing the quantity of prilled wax particles; and thermally fusing an outer layer of the compressed prilled wax particles to form a thermally fused outer layer of the candle.

13. The method of claim 12 wherein the thermally fusing step is accomplished by providing at least a portion of the inner surface of the mold with elevated temperatures during or after the compressing step.

14. The method of claim 13 wherein the elevated temperatures are between 29 and 49° C.

15. The method of claim 13 wherein the elevated temperatures are between and 34 and 45° C.

16. The method of claim 12, wherein the thermally fusing step is accomplished by applying heat after removal from the mold.

17. The method of claim 12, wherein the thermally fused outer layer is between 29 and 49 μm.

18. The method of claim 12, wherein the prilled wax particles further comprise paraffin.

19. The method of claim 12, wherein the prilled wax particles are compressed to a relative density of at least 0.93.

20. A candle comprising:

prilled wax particles, said particles comprising a blend of a hydrogenated natural oil and a hydrogenated metathesized natural oil, wherein the ratio of the hydrogenated natural oil to the hydrogenated metathesized natural oil ranges from about 10:1 to about 1:2, and further wherein at least about 90% of said particles have a particle size of less than 600 μm;

a compressed core comprising a major portion of said prilled wax particles;

a thermally fused outer layer comprising a minor portion of said prilled wax particles; and a wick;

wherein the compressed core has a relative density of at least 0.93.

* * * * *